US006729559B2

(12) United States Patent
Zanma et al.

(10) Patent No.: US 6,729,559 B2
(45) Date of Patent: May 4, 2004

(54) ROTARY AEROSOL PRODUCT

(75) Inventors: Shigekazu Zanma, Nara (JP); Masazumi Tanaka, Kyoto-fu (JP)

(73) Assignee: Daizo Co., Ltd., Osaka (JP)

( * ) Notice: Subject to any disclaimer, the term of this patent is extended or adjusted under 35 U.S.C. 154(b) by 0 days.

(21) Appl. No.: 10/149,978

(22) PCT Filed: Oct. 17, 2001

(86) PCT No.: PCT/JP01/09124

§ 371 (c)(1),
(2), (4) Date: Jun. 17, 2002

(87) PCT Pub. No.: WO02/32584

PCT Pub. Date: Apr. 25, 2002

(65) Prior Publication Data

US 2003/0029931 A1 Feb. 13, 2003

(30) Foreign Application Priority Data

Oct. 17, 2000 (JP) ..... 2000/316644
May 9, 2001 (JP) ..... 2001/139293

(51) Int. Cl.[7] ..... B05B 3/00

(52) U.S. Cl. ..... 239/225.1; 239/237; 239/263; 239/380; 239/141

(58) Field of Search ..... 239/140, 141, 239/225.1, 227, 237, 256, 263, 302, 380; 222/160, 162, 167, 168

(56) References Cited

U.S. PATENT DOCUMENTS 4,568,002 A * 2/1986 Weinstein et al. ..... 222/131
4,840,312 A * 6/1989 Tyler ..... 239/205
5,143,288 A * 9/1992 Kohler et al. ..... 239/1
5,377,914 A * 1/1995 Christen ..... 239/227
5,533,673 A * 7/1996 Wilson et al. ..... 239/337
5,746,374 A * 5/1998 Simonetti et al. ..... 239/240
5,785,250 A * 7/1998 De Laforcade ..... 222/402.13
6,027,042 A * 2/2000 Smith ..... 239/337
6,161,735 A * 12/2000 Uchiyama et al. ..... 222/105
6,283,327 B1 * 9/2001 Rubtsov ..... 222/105
6,474,563 B2 * 11/2002 Pletcher et al. ..... 239/3

FOREIGN PATENT DOCUMENTS

EP 1249482 A1 * 10/2002 ..... C09K/3/30
JP 56-11962 3/1981
JP 5-3241 1/1993
JP 5-5973 2/1993
JP 5-34779 9/1993
JP H10-120052 5/1998
JP H10-203572 8/1998
JP H10-309501 11/1998
JP 10309501 A * 11/1998 ..... B05B/9/04
JP P2000-233144 A 8/2000
JP 2002-59935 * 2/2002 ..... B65D/25/20

* cited by examiner

*Primary Examiner*—Henry Bennett
*Assistant Examiner*—Amanda Flynn
(74) *Attorney, Agent, or Firm*—Rader, Fishman & Grauer PLLC

(57) ABSTRACT

A rotatable aerosol product 10 comprising an aerosol product 11 and a rotatable stand 12 attached to the bottom part of the aerosol product, wherein spray continues during rotation and the rotation frequency is 35 frequencies/minute or lower. A spray hole 13*a* of a nozzle 13 is positioned eccentrically from the rotation center and rotated by counteraction of spray from the nozzle 13. Rotation frequency is regulated by a friction force between a rotation member 31 and a fixed member 32 or a ball 33.

27 Claims, 15 Drawing Sheets

FIG. 13a
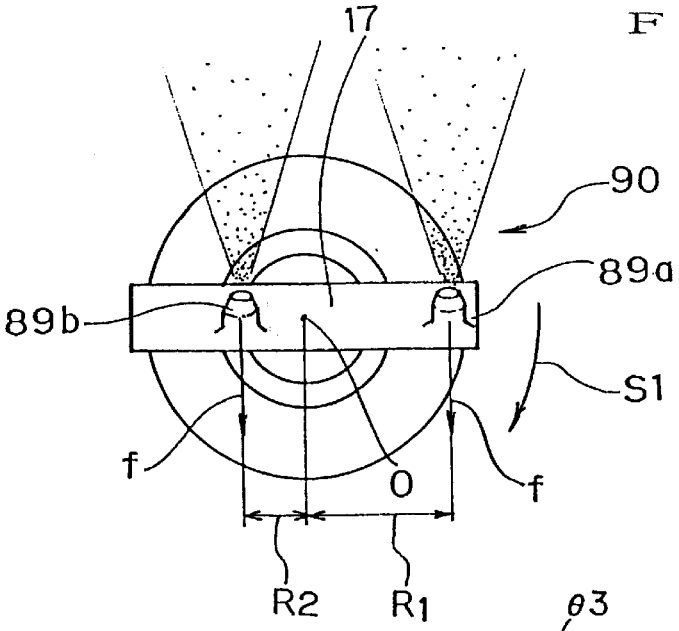
FIG. 13b
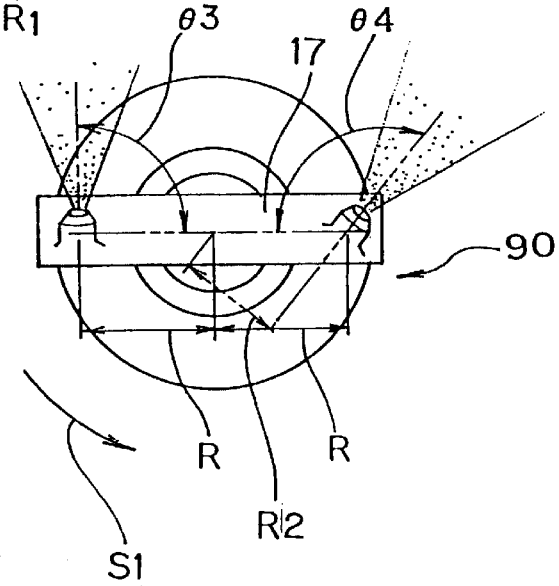
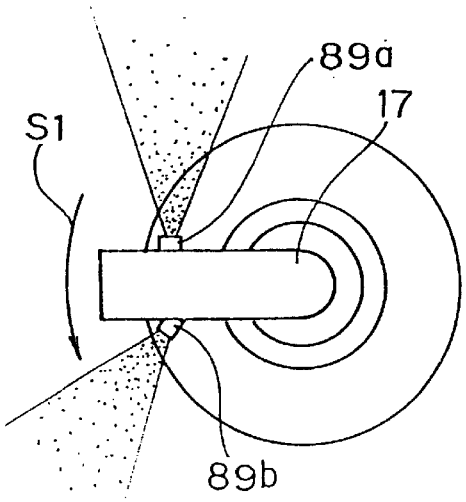
FIG. 13c

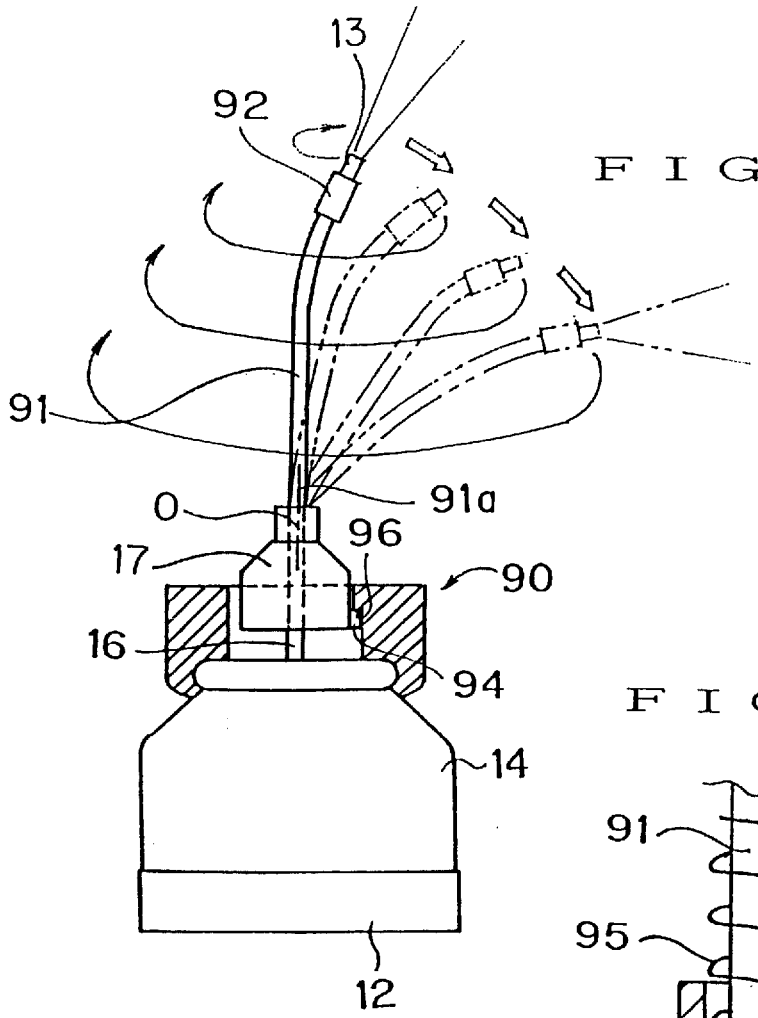
FIG. 14a
FIG. 14c
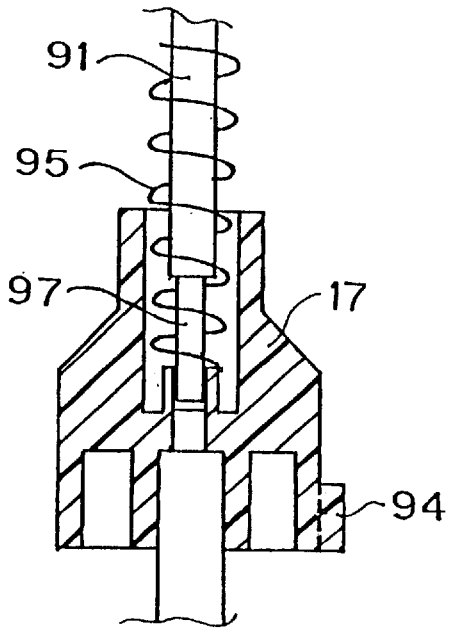
FIG. 14b
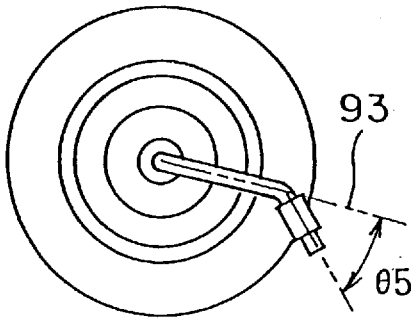

ROTARY AEROSOL PRODUCT

TECHNICAL FIELD OF THE INVENTION

The present invention relates to a rotatable aerosol product, more specifically, relates to a rotatable aerosol product having an excellent dispersion performance, such as that sprayed particles are widely dispersed in space or contact a floor surface in a wide range.

BACKGROUND ART

Conventionally, aerosol products or cans, such as for insecticide and fragrance, have been used for treating a space such as a room and inside of an automobile, and a floor surface such as tatami and carpet. As these aerosol products target spraying in a wide range or area, the sprayed particles should be dispersed widely. Therefore, an aerosol product of a so-called total amount spray type is used, where the product is set on a floor surface, instead of handing it, to spray the total amount of aerosol while a user takes shelter. In order to further extend a range of spray, aerosol products to be rotated by counteraction of spray to spray in a wide range have been proposed. In Japanese Examined Utility Model Publication 1981-11962, Japanese Examined Utility Model Publication 1993-3241, Japanese Examined Utility Model Publication 1993-5973, Japanese Examined Utility Model Publication 1993-34779.

The conventional rotatable aerosol product automatically rotates in a body by counteraction of spray, so that the particles spread in the 360-degree range around the product. Therefore, it has the advantage of spraying in a wide range, in comparison with an aerosol product of a fixed position type to spray simply upward or obliquely upward. However, the smooth rotation of such rotatable aerosol product may be interrupted, and occasionally, despite any remaining content, stops spraying before the entire amount is sprayed. In addition, the inventor found that even in a state of smooth rotation, the sprayed aerosol does not reach as far as in the case of spray without rotation. In other words, with a rotatable aerosol product, dispersion concentration is high near the aerosol product, but a farther distance away from the aerosol product is, the concentration abruptly becomes lower.

The inventor intended to solve the problems of an inappropriate rotation and interruption of spray, as seen in such rotatable aerosol product, and to improve a bearing mechanism to support an aerosol product. As a result, the inventors developed an aerosol product to rotate more smoothly. When the amount of the remaining contents becomes less, however, problems such as unsmooth rotations and interrupted spray, were still not solved but got worse. On the other hand, the inventor found a tendency that the sprayed aerosol reached a shorter distance when rotations became smoother.

In consideration of the above problems, the first technological object of the present invention is to provide an aerosol product to keep rotation smooth and to spray the total amount of the content as much as possible. Further, the second technological object of the present invention is to provide a rotatable aerosol product to make a reaching distance of the sprayed aerosol longer in order to spray in a wider range.

Through experiment and study on the reason why a rotatable aerosol product is interrupted from its smooth rotation and spray, the inventor found that in a rotatable aerosol product as shown in FIG. 17, an aerosol composition

102 contained in a container 101 moves to the outer-side of the container 101 by centrifugal force F and thereby a central part of a liquid face P lowers. In addition, when the amount of the aerosol composition contained in the container decreases, depending on positions of a sucking hole 105 of a dip tube 104 connected to an aerosol valve 103 , only the propellant is sprayed earlier to leave the concentrate. The inventor considered this as the reason for the above.

The reason why a spray-reaching distance becomes shortened has not been proven. It is conceivable, however, that in a case of spray with a retreating spray hole, as an aerosol product rotated by counteraction of spray, speed in air becomes relatively lower to make a spray-reaching distance shorter, even if the speed of spray from the spray hole is constant. On the other hand, when remaining in the atmosphere for a long time, an effective ingredient in the aerosol composition hazardous to living bodies, such as an insecticide may be inhaled by a human. Therefore, a size of a sprayed particle is regulated to a predetermined average or larger in order to fall on a floor and attach to a wall and the like within a certain time. Accordingly, it is presumable that when the speed is relatively low, the particles fall on a floor before reaching a far distance. On the other hand, it is also presumable that a direction of the spray hole changes continuously along with rotation, and hence, a flow of air caused by spray does not reach a far distance.

The inventor carried out, on the basis of the above hypothesis, experiments of spraying by intentionally lowering the rotation speed. As a result, the inventor found facts that, when rotation is carried out at a certain rotation frequency or less, the centrifugal force is suppressed to allow the total amount of the concentrate to be smoothly sucked and also the sprayed particles to reach a far distance. The inventor completed the present invention with these findings.

DISCLOSURE OF THE INVENTION

The aerosol product according to the present invention (claim 1) is characterized in that a part or a large part of a container including a spray hole rotates around a central axis in a vertical direction and spraying is maintained during rotation, and wherein the rotation is carried out at 35 frequencies per minute or fewer. The rotation is preferably 30 frequencies per minute or lower. In the aerosol product, the direction of the spray hole preferably ranges from −10 to 70 degrees upward to a horizontal plane (claim 2). In case of spraying in a space, the direction preferably ranges from 30 to 70 degrees upward to a horizontal plane, while in case of spray on a floor surface, preferably from −10 to 30 degrees upward to a horizontal plane. The spray amount preferably ranges from 7 to 30 g/10 seconds (claim 3).

A proportion of the propellant contained in the aerosol composition preferably ranges from 25 to 90 wt % (claim 4), more preferably from 30 to 85 wt %. The above rotating aerosol product is realized by using counteraction of spray (claim 5). However, other rotation-driving sources such as a motor can be used. In addition, a preferable product is one to rotate from 45 to 720 degrees for a period from the start of spray until the total amount is sprayed (claim 6), and also for a special usage, preferably to rotate from 45 to 90 degrees. Spray or rotation is preferably started after a predetermined time passes following the operation (claim 7). In another case, a product wherein 5 or more seconds are required from the start of the operation until rotation reaches 90 degrees is preferable (claim 8). In such aerosol product, a product having rotation resistance means whose resistance reduces after the start of rotation, is preferable (claim 9).

A preferable product is one to spray only gas immediately after the operation and after a predetermined time passes, to start to spray a concentrate (claim 10). Such aerosol product can be realized by means of communicating a valve with a gas phase part of the container immediately after the operation to make rotation by applying the counteraction of the sprayed gas, and when rotation speed increases communicating the valve with a liquid phase part of the container (claim 11). In addition, it can be realized by employing a closing member installed movably between a first position which closes a bottom hole communicating with a dip tube and a second position which closes a vapor tap, in which a radius of the second position from center of rotation is larger than the first position (claim 12).

The aerosol product, to rotate by counteraction of spray, may be constituted to have a first spray hole to rotate a part or a large part of the container in one direction against the center of rotation and a second spray hole to rotate it in the reverse direction and to realize rotation of the container is realized by a difference in the counteraction of spray from the first spray hole and the second spray hole (claim 13). It may also be constituted so that a part of the container including the spray hole is installed movably to another part of the container between a first radial position and angle position having a small torque of counteraction and a second radial position and angle position having a large torque of counteraction, and so as to move from the first position to the second position when the centrifugal force becomes large (claim 14). In addition, a nozzle may be installed rotatably from an erect state to a fallen state against the top end of the main body of the container and be energized elastically to normally direct upward, and a spray hole is formed on a front end of the nozzle to direct the spray to the outside (claim 15).

In case of rotation caused by other than counteraction, a first spray hole for backward spray to a direction of rotation and a second spray hole to spray forward can be provided (claim 16). Also in this case, the angles of the vertical and/or horizontal direction of the said first and second spray holes can be different (claim 17).

The aerosol product according to the present invention (claim 1) rotates at 35 frequencies/minute or lower, and therefore, the central part of the liquid face of the aerosol composition in the container hardly lowers. Consequently, in the aerosol product using the dip tube, the sucking orifice thereof does not appear from the liquid face to the upward part during spraying and the propellant is never sprayed separately. In addition, even in case of a spray hole moving to a direction opposite to a spraying direction, the relative speed of the sprayed particles does not lower so much against air and the spray-reaching distance is around 70 to 98% of the case of a non-rotating aerosol product. Thus, the product can spray sufficiently far. Further, in case of rotation of 30 frequencies/minute or lower, lowering of the liquid face is even smaller while the reaching distance of the sprayed particles becomes longer to allow wide dispersion such as in a room.

When the direction of the spray hole is set at−10 to 70 degrees upward to a horizontal plane (claim 2), the product can disperse far from the top of the aerosol product and into a space or onto a floor surface in a room widely. In other words, in case of an angle smaller than −10 degrees (downward), the particles are dispersed only on a floor surface in a narrow range around itself, while in case of an angle over 70 degrees, it is dispersed only upward the aerosol product, but not far reaching. When in a range from 30 to 70 degrees, the particles can be dispersed widely to an indoor space to be preferable for space spray. In other words, in an angle smaller than 30 degrees, the particles are dispersed more around a floor surface while dispersion in space decreases. On the contrary, when an angle of the spray hole is set −10 to 30 degrees to a horizontal plane, the sprayed particles are not dispersed to a high position but can be attached to a floor surface widely, resulting in preferable floor surface spray. In other words, an angle over 30 degrees causes vain attachment of the sprayed particles to a high position.

When the spray amount is set 7 to 30 g/10 seconds (claim 3), the particles can reach far enough, and also, the concentration of the propellant does not abruptly increase in a space. In other words, when sprayed amount is less than 7 g/10 seconds, the particles do not reach far enough, and if rotation is caused by counteraction of the spray, full rotation is not obtained. On the contrary, when the spray amount exceeds 30 g/10 seconds, the concentration of the propellant abruptly increases in a space to be dangerous. In addition, as the counteraction of spray increases, the product does not rotate stably.

When the propellant of the aerosol composition is prepared in a proportion ranging from 25 to 90 wt % (claim 4), the average size of the sprayed particles is appropriate to be dispersed in a wide range and reach far. In other words, in case of proportion of the propellant less than 25 wt %, sprayed particles become large, so that the particles can easily drop in a liquid state. In addition, spray speed becomes slow, and thus, the particles are not distributed in a wide range. Moreover, in case of rotation by counteraction of spray, the amount of the propellant is excessively small, and hence, it is difficult to spray the total amount with rotation. On the contrary, when a proportion of a propellant exceeds 90 wt %, sprayed particles become excessively small, so that they do not reach far. In addition, as a spray force is strong, when rotation is realized by counteraction, it is difficult to suppress rotation to 35 frequencies/minute. When a proportion of a propellant ranges from 30 to 85 wt %, however, it is advantageous that particles are dispersed to wider areas and also reach far.

When counteraction of spray is used as a driving source of rotation of an aerosol product (claim 5), other driving sources are not needed, resulting in a simple structure. In case of using other driving sources such as a motor or a spring, the torque for rotation does not depend on a magnitude of an internal pressure. Therefore, rotation can be easily carried out despite of the amount of the remaining content.

In an aerosol product rotating 45 to 720 degrees for a period from the start of spray until the total amount is sprayed (claim 6), rotation seldom causes a bad effect and dispersion can also be realized enough in a preferable range. On the other hand, when spray is completed with rotation at an angle of 360 degrees or smaller, particularly from 45 to 90 degrees, for example, when a range to be sprayed is restricted such as a case of arranging at a corner of a room, an advantage to avoid any vain spray is obtained. In addition, with a product starting spray or rotation when a predetermined time passes after operation (claim 7), a user or operator can take shelter before spray or rotation starts. Hence, there is less probability of that a user receives or inhales any sprayed concentrate.

On the other hand, even if the product starts spray or rotation immediately after operation, when it requires 5 or more seconds from operation to reach a 90-degree rotation (claim 8), spray can be confirmed through operation in a state where the spray hole is directed to a side opposite to the user. In addition, the spray hole is not directed to a user's side for 5 seconds or longer. Therefore, there is enough time for the user to take shelter and it is prevented that the user receives or inhales any sprayed concentrate. When such aerosol product is provided with a rotation resistance means reducing resistance after rotation starts (claim 9), rotation speed is lowered by the rotation resistance means, so that counteraction of spray and the like can be used as a rotation driving means. Therefore, the rotation driving means can be easily constituted and rotation speed can also be lowered in an early stage of rotation to save time for a user to take shelter.

With a product spraying only gas immediately after operation and starting to spray a concentrate after a predetermined time passes (claim 10), if taking shelter during spray of gas, a user is free from inhalation of the concentrate containing an effective ingredient such as an insecticide. In an aerosol product with means of communicating a valve with a gas phase of an inside of a container to rotate by a reaction force of sprayed gas immediately after operation and then communicating the valve with a liquid phase of the inside of the container when increasing rotation speed (claim 11), when the rotation speed is low, only gas is sprayed through the valve, while, in increasing the rotation speed, the contents in the liquid phase (the concentrate and liquefied gas) is sprayed through the valve. In an aerosol product with a closing member installed movably between first position which closes a bottom hole communicating with a dip tube and second position which closes a vapor tap, in which radius of the second position from center of rotation is larger than the first position (claim 12), when rotation is slow, the closing member closes the bottom hole and releases the vapor tap, and therefore, a gas phase part is communicated with a valve by the vapor tap. In addition, when rotation speed increases, the closing member is moved by centrifugal force to close the vapor tap, resulting in release of the bottom hole. Thereby, communication of the gas phase part with the valve is blocked off and the valve is communicated with the liquid phase through the dip tube and the bottom hole.

When a rotatable aerosol product has a first spray hole to rotate the container in one direction against the center of rotation and a second spray hole to rotate it in the reverse direction, where the container is rotated by a difference in counteraction of spray from the first and second spray holes (claim 13), it is possible to reduce rotation keeping a large amount of spray. In addition, one spray hole proceeds spraying, so that the concentrate reaches far. On the other hand, as reaching distances of the concentrate differ between the both spray holes, the liquid can be widely distributed in a range between near and far from the container. For reference, when the spray amount from the one spray hole reduces, the spray amount from the other spray hole also reduces, and therefore, both the spray amounts balance to reduce the speed moderately as a whole.

In addition, in a rotatable aerosol product characterized in that that a part of the container including a spray hole is installed movably to other parts of the container between a first radial position and angle position with a small torque of counteraction and a second radial position and angle position with a large torque of counteraction, and moves from the first position to the second position when the centrifugal force becomes large (claim 14), as rotation becomes faster, the centrifugal force becomes larger, thereby making the radial position or the angle position of the spray hole move gradually to the second position with a large torque. Hence, rotation becomes faster. Consequently, rotation is slow in the early stage to allow an operator to take shelter easily, and thereafter, rotation gradually becomes faster. The sprayed concentrate changes its reaching distances according to changes of rotation speed, and thus, dispersion of the concentrate can be uniform.

When a rotatable aerosol product is provided with a nozzle rotatable between erect and fallen states to the top end of the main body of the container and elastically energized to normally direct upward and a spray hole directed toward the outside at the front end of the nozzle (claim 15), in the early stage where spray force is strong and rotation is fast, the nozzle is fallen by the centrifugal force to direct the spray hole almost horizontally, and thereby, the concentrate is widely sprayed. Subsequently, rotation gradually becomes slow, the centrifugal force becomes small, and therefore, the nozzle is gradually directed upward by the energizing force to make it upward. Thus, the liquid is concentrically sprayed upper the aerosol product. Consequently, until the total amount is sprayed, the aerosol product sprays in a range between farand near itself totally and uniformly.

On the other hand, even in case of a product without rotation by counteraction, when a first spray hole to spray backward to a direction of rotation and a second spray hole to spray forward are provided (claim 16), the force of forward spray from the second spray hole is stronger than the force of backward spray from the first spray hole, so that spray ranges differ between the both holes. Therefore, the product can spray in a wider range. In addition, counteraction of forward and backward spray offset each other, and thus, a load of the rotation driving mechanism becomes small to make control of the rotation speed easy. In this case, if the angles of the horizontal and/or vertical direction between the first and second spray holes are made different, the spray range of both can be further changed to realize spray in a wider range.

BRIEF DESCRIPTION OF THE DRAWINGS

FIGS. 13*a* to 13*c* are all plan views showing still further embodiment of the aerosol product according to the present invention.

FIG. 14*a* and FIG. 14*b* are a side view and a plan view, respectively, showing still further embodiment of the aerosol product according to the present invention and FIG. 14*c* is a sectional view of an essential portion showing the still further embodiment of the aerosol product according to the present invention.

THE PREFERRED EMBODIMENTS OF THE PRESENT INVENTION

Figure 1:
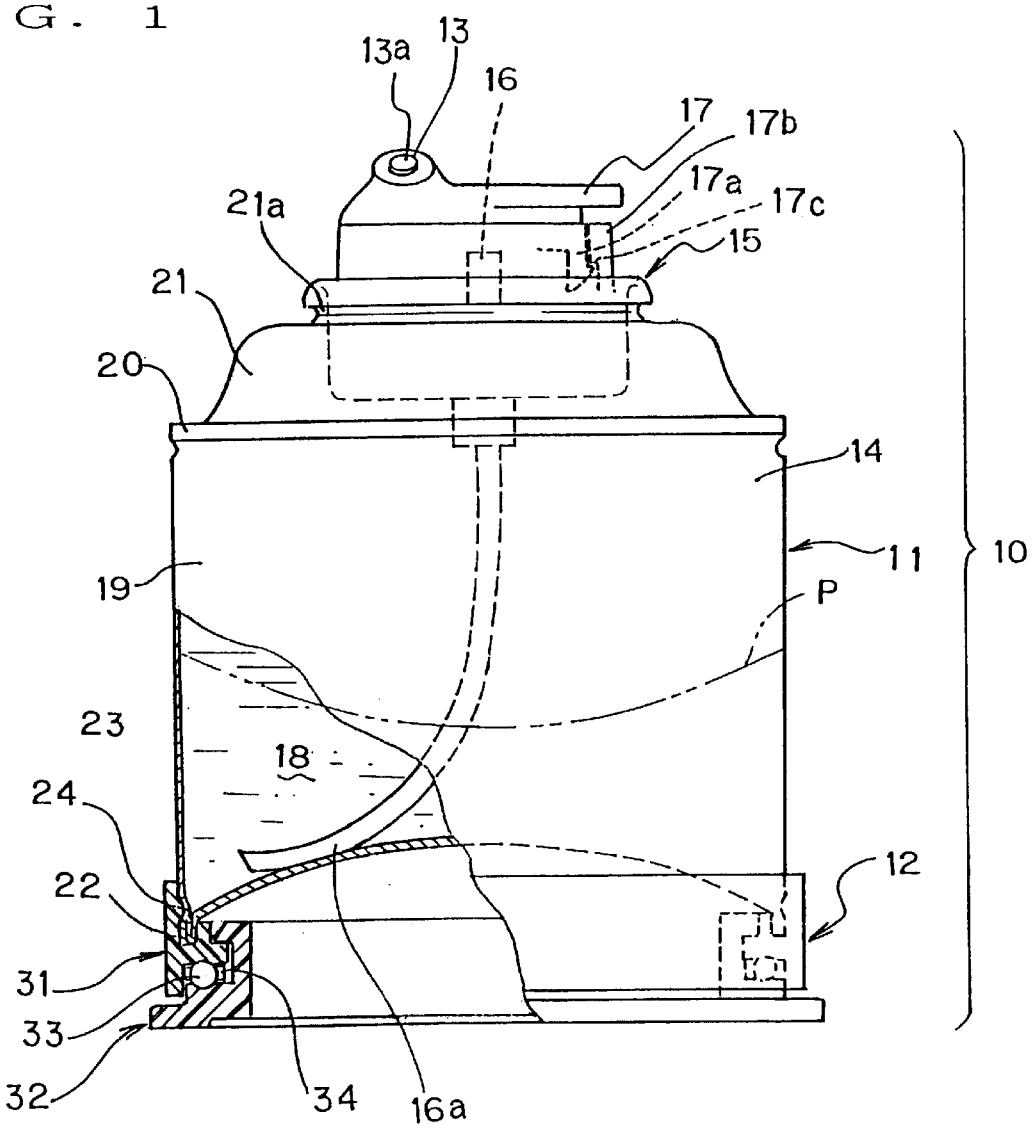
FIG. 1 is a partially sectional frontal view showing an embodiment of the rotatable aerosol product according to the present invention.

A rotatable aerosol product 10, shown in FIG. 1, comprises an aerosol product 11 and a rotatable stand 12 fitted to the bottom portion of the aerosol product. The aerosol product 11 excluding a nozzle 13, is an aerosol product of a conventional total amount spray type, and comprises a container 14, a valve 15 fixed to the top part of the container, and a button 17 fitted to a stem 16 of the valve. For reference, a reference numeral 16*a* is a dip tube connected to the bottom part of the valve 15. The container 14 is made to be lower in height and larger in a diameter in comparison with the conventional aerosol product that is held by hand for spraying. Therefore, the rotatable aerosol product is stabilized when the aerosol is sprayed and it sets on a floor and and rotates.

In the inside of the container 14, an aerosol composition 18 consisting of a concentrate (a drug liquid containing an effective ingredient) and a propellant fills the container. The effective ingredient is prepared with an insecticide, a pest repellent, a deodorant, a fragrance, a bactericide, an abstergent and the like to be sprayed in a space in a room, an automobile and the like or to attach to or contact a tatami, carpet, floor, sofa, curtain, a body of an automobile and the like. The propellant is prepared with a liquefied petroleum gas such as propane, butane or a mixture thereof and liquefied gas such as dimethyl ether, freon-based liquefied gas or the mixture thereof. In addition, as a pressurizing agent, a compressed gas such as carbon dioxide, nitrogen, nitrogen suboxide and compressed air may be used. The concentrate and the propellant are filled together in the container 14. When the valve 15 is opened to release both components to the outside, the propellant is vaporized at the valve 15, the stem 16 or the nozzle 13. At this time, the concentrate is made into fine particles that sprays to the outside in a mist together with gas of the propellant. On the other hand, in case of using an abstergent, the concentrate may be a spray foam, containing a foaming agent such as a surfactant, sprayed in a mist and making foam on an attaching face.

Consequently, when the above propellant is contained in a higher proportion while the concentrate is contained in a lower proportion, the concentrate becomes fine spray particles. On the other hand, when the propellant is contained in a lower proportion while the concentrate is contained in a higher proportion, spray particles tend to become rough. Therefore, as described in the previous section of action, a preferable proportion of the propellant in the aerosol composition 18 ranges from 25 to 90 wt %, and more preferably from 30 to 85 wt %.

Figure 2A:
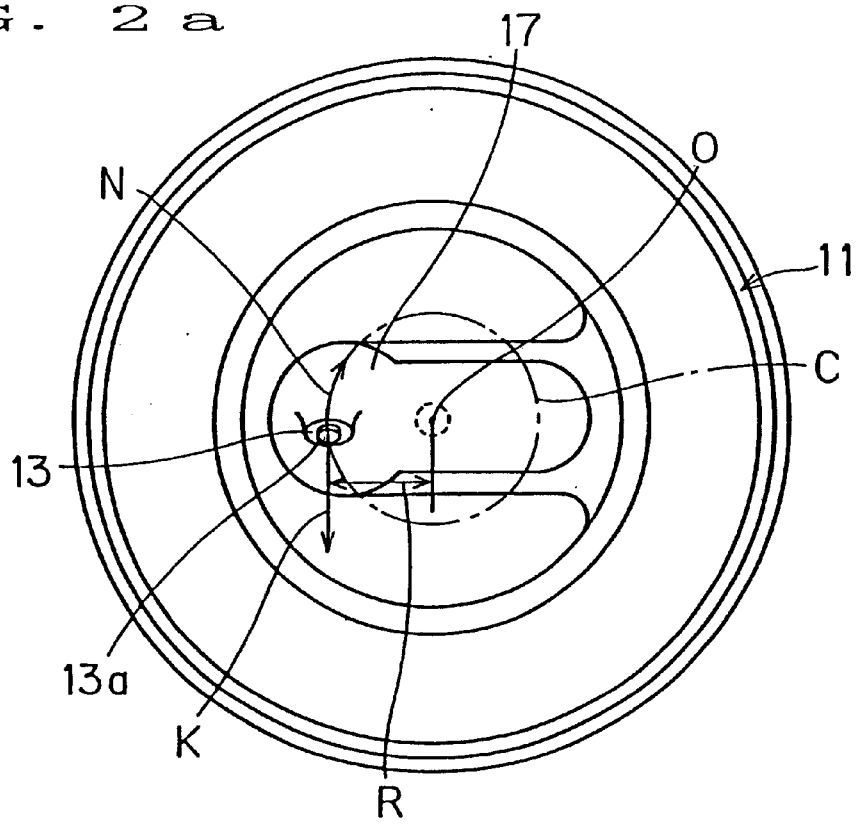
FIG. 2*a* and FIG. 2*b* are a plan view and a side view showing an angle of a nozzle in FIG. 1.
Figure 2B:
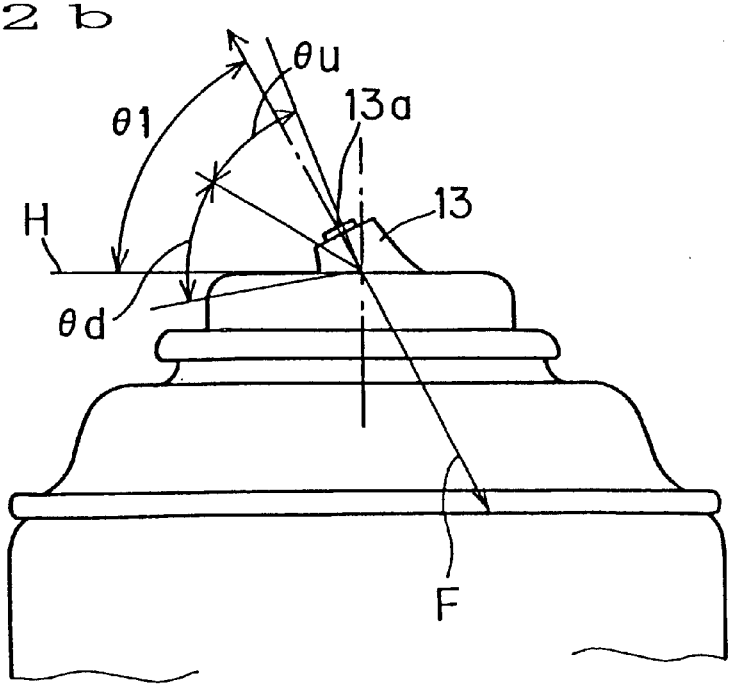

The button 17 has the nozzle 13 facing toward a direction eccentric from a radial position of the container 14 in an obliquely upward direction. As shown in FIG. 2*a*, a spray hole 13*a* of the nozzle 13 in a bird's-eye view faces backward (arrow K) to a direction of rotation (arrow N) in a tangential direction of a circle C around a rotation center O. Then, concerning a vertical direction, as FIG. 2*b*, an angle θ1 against a horizontal plane H is set about 60 degrees upwardly. For reference, the direction of the nozzle 13 is preferably set −10 to 70 degrees upwardly from the horizontal plane, and as described in the previous section of action, it is preferable that an angle θu in space spray is set about 30 to 70 degrees and an angle θd in floor face spray is set about −10 to 30 degrees.

The size of the spray hole 13*a* of the nozzle 13 may be the same as that of a normal space spray or a floor surface spray, for example, a diameter preferably ranging from 0.3 to 1.0 mm. In other words, in case of a spray hole diameter smaller than 0.3 mm, the spray amount becomes less, thereby failing to dispose over a wide range. In addition, in case of rotation by counteraction of spray as this embodiment, counteraction is small, so that stable rotation is not realized. On the contrary, in case of a spray hole diameter larger than 1.0 mm, the spray amount becomes excessive, and thus, concentration of sprayed particles becomes abruptly higher. In case of rotation by counteraction of spray, this is because rotation speed becomes excessively higher, so that it is difficult to make rotation frequency in a range within a predetermined one. In addition, the spray amount defined by shapes of the nozzle 13 and the valve 15, a proportion of the propellant in the composition and a pressure of the inside of the container 14 preferably ranges from 7 to 30 g/10 seconds as the above description of action.

In the aerosol product 10 of Fig., in order to spray the total amount of the aerosol product 18, a conventionally and publicly known lock mechanism is installed between the button 17 and the valve 15 to keep a pressing state at pressing the button 17. Such lock mechanism can be constituted, for example, by an engaging tip 17*a* mounted on the button 17 and a engaging portion 17*c* mounted on a cover 17*b* supporting the button swingably.

For reference, according to this embodiment, the container 14 is a so-called 3-piece can comprising a cylindrical trunk portion 19, a dome 21 fixed to the top portion thereof by a winding-up part 22, and a bottom portion 23 fixed to the bottom portion of the trunk portion 19 by the winding-up part 22. The valve 15 is crimped to the bead part 21*a* formed on the top part of the dome 21. The bottom portion 23 is curved in a center and the winding-up part 22 combining the trunk part with the bottom part shows an annular shape projecting downward. In addition, an outer circumferential part of the winding-up part 22 is made in an almost same diameter as the trunk portion 19, and thus, an annular recess portion 24 is placed at an immediately upward portion of the winding-up part 22.

The rotatable stand 12 comprises an annular rotatable member 31 filled in the winding-up part 22, an annular supporting member 32 arranged in a downward position of the rotatable member 31, a plurality of balls 33 interposed between the both members, and a retainer 34 keeping a distance between the balls.

Figure 3A:
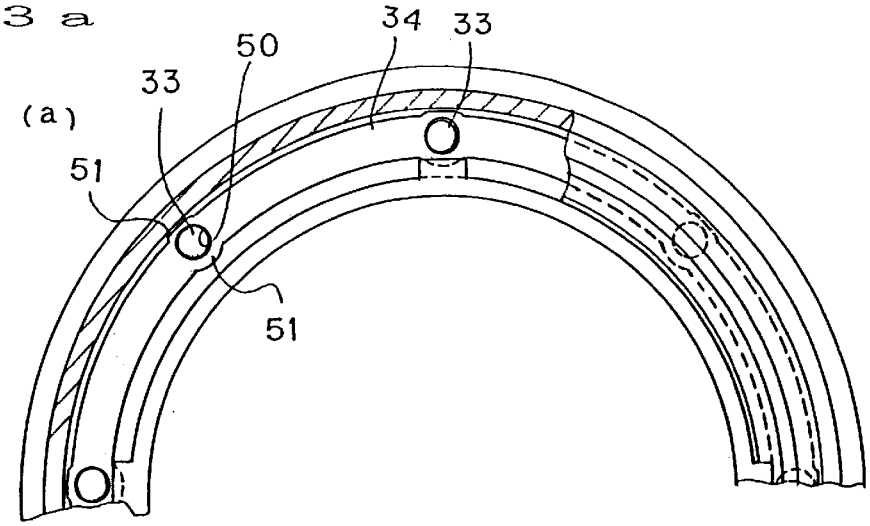
FIG. 3*a* and FIG. 3*b* are a plan view of an essential portion, with parts broken away for the sake of clarity, and a longitudinally sectional view of a rotatable stand in FIG. 1.
Figure 3B:
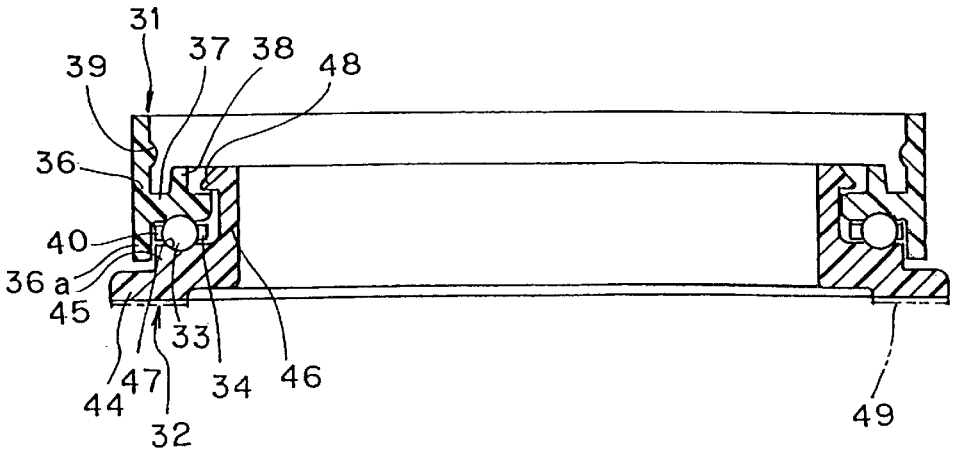

As shown in FIG. 3*b*, the rotatable member 31 comprises a cylindrical outer circumferential wall 36, an annular pressing part 37 projecting to an inside of the outer circumferential wall 36, and a cylindrical projection 38 erect on a top face of the pressing part 37. The top part of the outer circumferential wall 36, the top face of the pressing part 37, and the projection 38 form a fitting groove to fit to the winding-up part 22 on the bottom end of the container in FIG. 1. On an inner face of the top part of the outer circumferential wall 36, an engaging projection 39 elastically engaging with the annular recess portion 24 of the container 14 in FIG. 1 is projecting. The engaging projection 39 may continue in a circumferential direction or may be an independent projection arranged with a predetermined interval. On the bottom face of the pressing part 37, an annular groove 40 is formed, where the ball 33 is rolled. The annular groove 40 is a rolling face. On the other hand, the bottom part of the outer circumferential wall 36 is an outer cylinder 36*a* to protect the ball 33.

The supporting member 32 has a bottom board 44 made of an annular board body, an annular step part 45 installed in the inside of the bottom part, and an inner cylinder 46 erected from the inner end of the step part. On the top face of the step part 45, an annular groove 47 is formed to roll the ball 33. The outer circumference of the bottom board 44 projects to the outside of the outer circumferential wall 36 of the rotatable member 31. The bottom end of the outer circumferential wall 36 of the rotatable member 31 is lower than the step part 45 in a state of the rotatable stand 12 assembled. The inner face of the outer circumferential wall 36 faces the outside of the outer circumferential face of the step 45 through a space. In addition, the inner cylinder 46 of the supporting member 32 extends upward of the pressing part 37 of the rotatable member 31 and on the outside face of the top end thereof, a hook 48 is installed to engage with the top face of the pressing part 37 through a space. The hook 48 is, for example, as shown in FIG. 3*b*, installed on 4 places on a circle. Those hooks 48 are made easy to be inserted into the inside of the rotatable member 31 with the outer face thereof as tapered plane.

The rotatable member 31 and supporting member 32 can be made of a synthetic resin, a metal and the like. In case of a synthetic resin, there are advantages of a light weight and no rust occurrence. On the other hand, the winding-up part 22 of the container 14 is fitted closely to the fitting groove of the rotatable member 31. In addition, for the bottom face 44 of the supporting member 32, a seal 49 with a high friction coefficient may be adhered to or a synthetic resin layer may be put on to prevent slip. Thereby, stable rotation can be realized. In addition, a 2-face adhering sheet or gluing sheet may be adhered, thereby to realize tight fixation on a floor and the like. In this case, a release paper is normally adhered.

Figure 8:
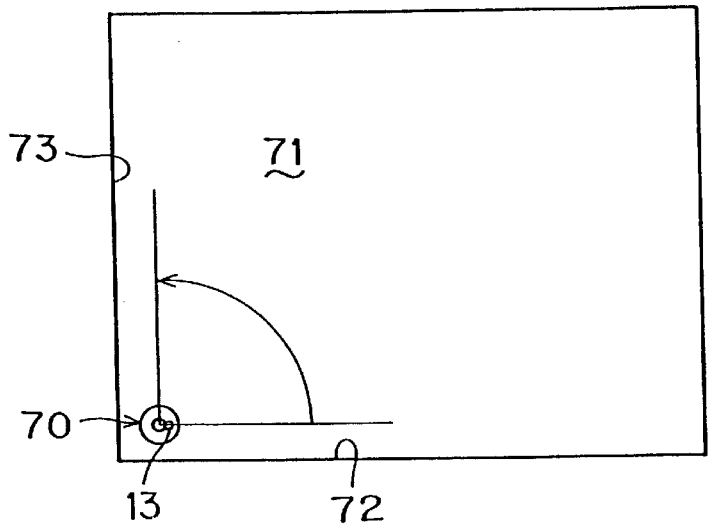
FIG. 8 is a frontal view, with parts broken away for the sake of clarity, showing still further embodiment of the rotatable aerosol product according to the present invention.

The ball 33 may be a steel ball used as a normal ball bearing. However, other metal-made balls may be used and they may be synthetic resin. It is preferable to blend lubricant oil with a synthetic resin for smooth sliding. The number of the balls 33 is not specially restricted. In FIG. 3*a*, 8 balls are used, but 3 or more balls are suitable, and about 4 to 16 balls, particularly 6 to 12, are preferable. In replacing the ball 33, a cylindrical or a conical stand-like roller may be used to make a structure of a roller bearing. In addition, a needle-like roller may be used to make similar to a needle bearing.

As shown in FIG. 3*a*, the retainer 34 is an annular board member, where a through hole 50 is provided in a position to insert the ball 33, and molded from a metal, a synthetic resin and the like. As in FIG. 3*a*, in order to reinforce the site provided with the through hole 50, projecting portions 51 are made in the inner and outer sides, respectively, to increase a width of the site in comparison with those of other sites.

The friction coefficient of rotation of the above rotatable stand 12 differs depending on a quality and molding precision of the rotatable member 31, the annular supporting member 32 and the ball 33, precision of fitness and a kind of the lubricant if used. In the present embodiment, rotation is determined to be at 35 frequencies/minute or fewer and smooth, when the aerosol composition is sprayed from the nozzle 13 and the counteraction thereof causes rotation. For reference, a lower limit of rotation number is not specially restricted, but normally determined to 1 rotation or more, in other words, 360-degree or more rotations, before the total amount is sprayed. However, when the range of a spray direction is restricted, for example, in case of using a deodorant for a rest room and of spraying from an entrance of a corner of a room to an inside (see FIG. 8), the rotations may be fewer than that of the above described.

Figure 9:
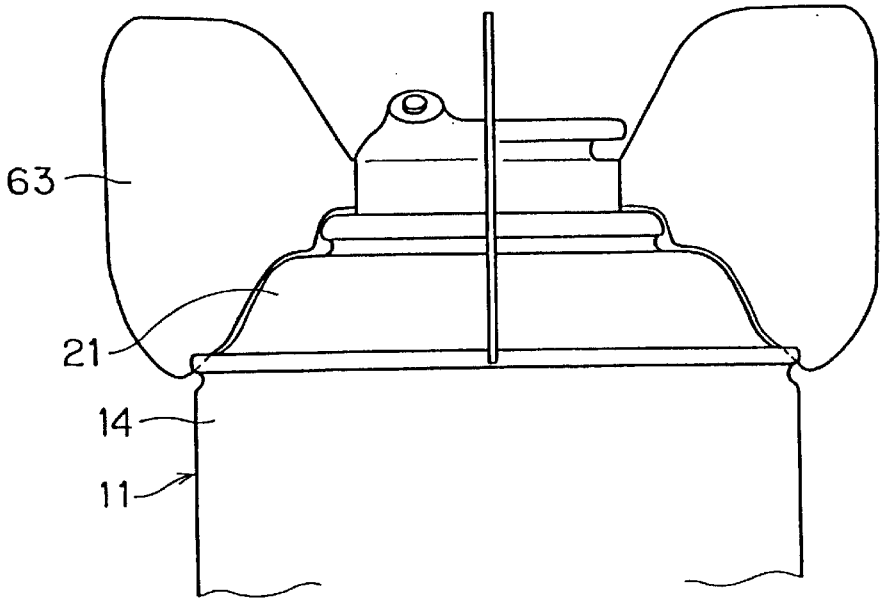
FIG. 9 is an outlined plan view showing a working state of the still further embodiment of the rotatable aerosol product according to the present invention.

On the other hand, besides the rotatable stand 12, rotation frequency of the aerosol product can also be suppressed by increasing a fluid frictional resistance against air by providing blades on the container 14 (see FIG. 9). Furthermore, a member to disturb rotation of the aerosol product can be installed in the inside of the container 14 to suppress rotation of the aerosol product, thereby to prevent the center of a liquid face from lowering. When rotation frequency is decreased by reducing an internal pressure, making the spray hole of the nozzle 13 smaller and thereby decreasing spray speed and the spray amount from the nozzle 13. However, the reaching distance of sprayed particles is not far and this is not preferable. In other words, it is preferable that rotation is suppressed intentionally while keeping a spray condition to the reaching distance of sprayed particles of 1 to 5 m in the state of no rotation. For reference, even when rotation is reduced by reducing the spray amount as described above, centrifugal force is reduced, and therefore, the central part of the liquid face (a phantom line P of FIG. 1) inside the container 14 is not so lowered. Thus, this is a solution of a problem, that the front end of the dip tube 16*a* appears from the liquid face P to release only the propellant during a spraying process.

For using the rotatable aerosol product constituted according to the above described condition, the product is first put on a surface such as a floor of a room and then, the button 17 of the FIG. 1 is pressed. Thus, the engaging piece 17*a* of the button 17 is engaged with the engaging portion 17*c* of the cover 17*b* to keep a pressing state, finally making the aerosol composition spray from the nozzle 13. By the counteraction of this process, the aerosol product 11 and the rotatable member 31 start to roll themselves in the opposite direction to the spray direction, rolling on a row of the balls 33. In addition, as known from FIG. 2, the counteraction F works obliquely downward, and thus, only a horizontal component (F·cos θ) of the counteraction contributes to rotation. Therefore, larger an angle θ is, slower rotation speed becomes. On the other hand, a vertical component (F·sin θ) presses the aerosol product 10 only downward. Consequently, this does not contribute to rotation but increase friction to disturb rotation. A torque for rotation of the aerosol product 10 is gained from a product of multiplication of the horizontal component of the counteraction to a distance R from the rotation center O to the spray hole 13*a*. Then, by the torque, rotation gradually increases and reaches rotation in an almost constant velocity at a point when a resistance against rotation balances with the torque. Therefore, smaller ones of distances R show a slower rotation speed.

Then, also in this embodiment, rotation is defined at 35 frequencies/minute or fewer, and thus, a moving speed of the spray hole is not so fast and spray force of the propellant is consumed to carry sprayed particles far away. Thus, the sprayed concentrate reaches far. In addition, spray is carried out with the spray hole rotating, allowing dispersion in a wide range in a space. On the other hand, as the central part of the liquid face of the aerosol composition 18 in the container 14 lowers not so largely, the propellant is released during spraying and almost the total amount can be sprayed completely.

On the other hand, the weight of the aerosol product 10 is loaded on the winding-up portion 22 during rotation and supported by the supporting member 32 through a plurality of the balls 33. Therefore, it rotates stably. Along with rotation, the aerosol composition in the container 14 moves to the outer circumferential direction and swings reducing the weight thereof, but is stably supported by the row of the balls 33 dispersed in a wide range.

When the remaining amount of the aerosol composition becomes less, the weight of the aerosol product 10 becomes smaller, and thus, the frictional resistance against rotation reduces. However, liquefied gas is continually sprayed, so that vaporization of liquefied gas is repeated inside the container to cool the aerosol composition in the container. As the result, the internal pressure of the container 14 reduces, and thus, rotation does not become so fast, but is reduced. Consequently, the propellant is not separately released during spraying. For reference, in case of rotation by counteraction of spray as described above, rotation is slow immediately after start of spray and when the remaining amount becomes less. However, the condition of rotation of 35 frequencies/minute or less according to the present invention should be satisfied, when rotation is kept stable (preferably from start until finish of rotation).

Figure 4A:
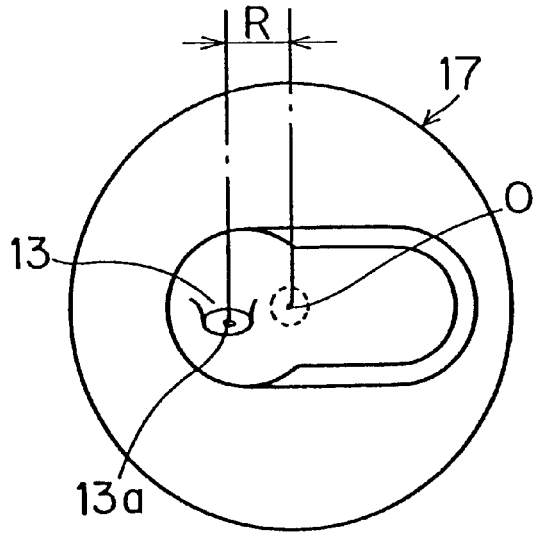
FIG. 4*a* and FIG. 4*b* are both the plan views showing other embodiment of the angle of the nozzle according to the present invention.
Figure 4B:
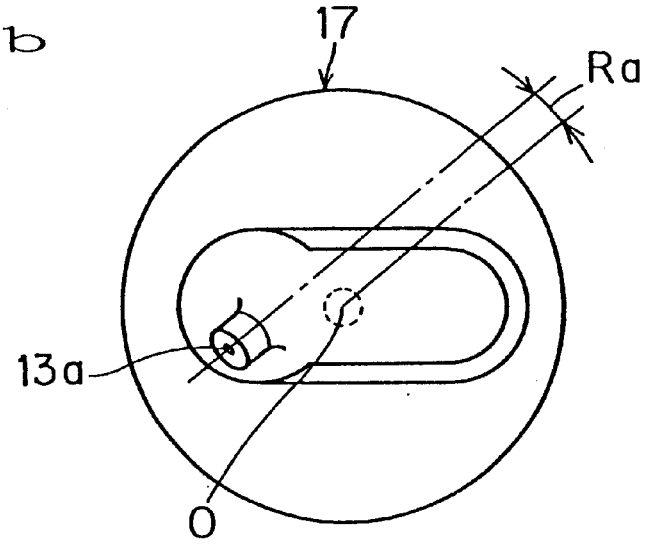

The button 17 shown in FIG. 4*a* is almost the same as that in FIG. 1, but the distance R from the rotation center O to the spray hole 13*a* of the nozzle 13 is as small as 2 to 10 mm. Therefore, even if the spray force is the same in scale, the torque to rotate the aerosol product becomes small, resulting in slow rotation speed. For reference, the direction obliquely upward is same as that in FIG. 2*b*. On the other hand, even if the distance from the rotation center O to the spray hole 13*a* is large as shown in FIG. 4*b*, when an angle is made so as to direct the spray hole 13*a* outward, a distance Ra corresponding to an arm of torque becomes small, and hence, rotation speed can be lowered substantially as that of the button 17 in FIG. 4*a*

Figure 4C:
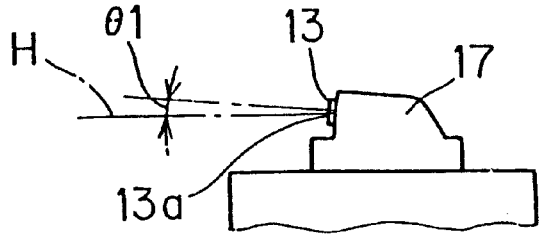
FIG. 4*c* is a side view showing another embodiment of the nozzle according to the present invention.

The button 17 in FIG. 4*c* is used for floor spray and an angle θ1 against the horizontal plane H of the spray hole 13*a* of the nozzle 13 is small making almost horizontal position. Thus, in case of such almost horizontal position, the reaction force, as it is, of spray becomes force for rotation. Therefore, as shown in FIG. 4*a* or FIG. 4*b*, it is preferable to set the spray hole 13*a* near the rotation center O or make the position outward.

Figure 5:
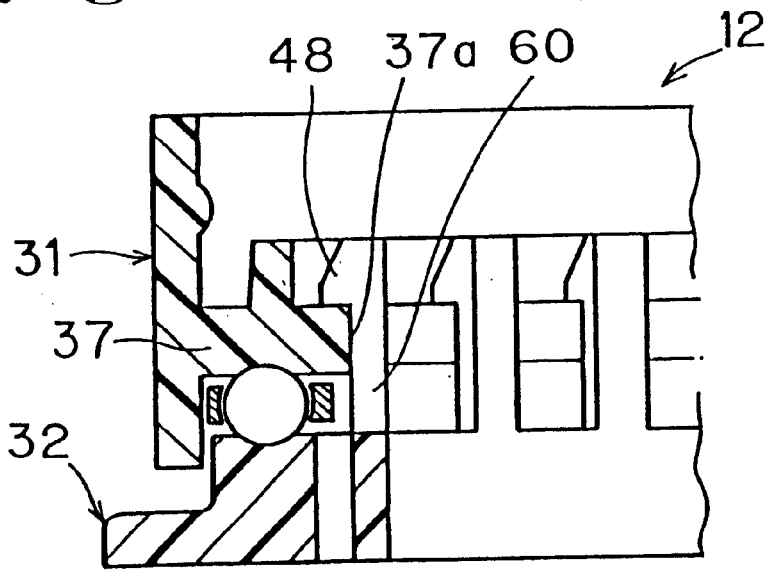
FIG. 5 is a sectional view of the essential portion showing other embodiment of the rotatable stand according to the present invention.

In the rotatable stand 12 shown in FIG. 5, the hook 48 is installed on the top end of a flexible piece 60 capable of elastic deformation and the flexible piece 60 always abuts elastically against the end part 37*a* of the pressing portion 37 of the rotatable member 31. The preferable number of the flexible piece 60 ranges from 4 to 12. Friction resisting rotation occurs with the flexible piece 60 when the rotatable member 31 rotates. Thus, rotation speed becomes slow. In other words, the flexible piece 60 works as breaking means against the rotatable member 31.

Figure 6:
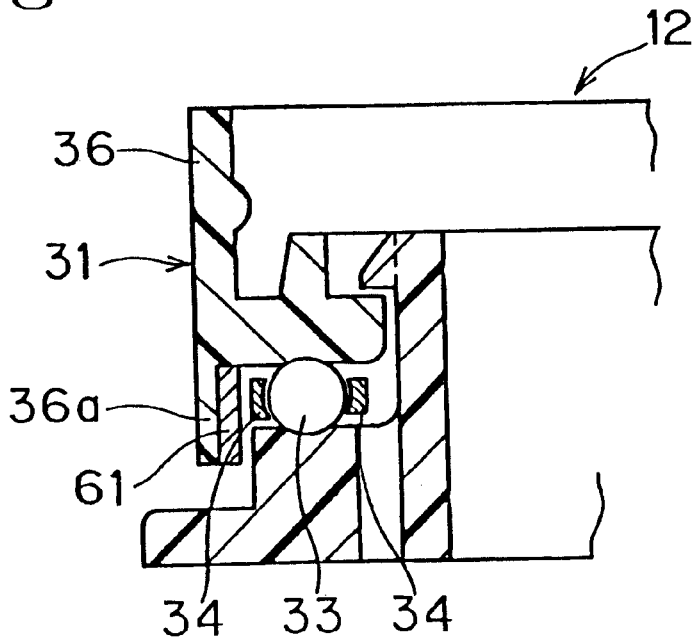
FIG. 6 is a sectional view of the essential portion showing another embodiment of the rotatable stand according to the present invention.

In the rotatable stand 12 shown in FIG. 6, a magnet 61 is embedded in the inner face of the outer cylinder 36*a* of the bottom part of the outer circumferential wall 36 of the rotatable member 31 and the ball 33 is a steel ball attracted by the magnet 61. Therefore, the ball 33 is attracted outward by the magnet 61, and then, the friction force occurs between the ball 33 and the retainer 34. Then, the friction force causes lowering of the rotation speed of the rotatable member 31. In other words, the magnet 61 and the ball 33 constitute the breaking means. In addition, this tends to move the ball 33 outward by the centrifugal force as the rotatable member 31 rotate in higher speed. Hence, an attracting force of the magnet increases in arithmetic progression. As the result, as the rotation speed is increasing, the breaking force increases, and therefore, rotation becomes stable in a lower range.

In the aerosol product 11 shown in FIG. 9, a plurality of blades 63 is radially fitted around the top part of the container 14, particularly around the dome 21. These blades 63 increase air resistance in rotation of the container 14 and decrease the rotation speed. Then, the air resistance increases according to an increase in rotation. The blade 63 also becomes the braking means and contributes to suppression of rotation of the aerosol product 11 to 35 frequencies/minute or fewer. On the other hand, when an angle of the blade 63 is made to slightly horizontal or oblique to the rotation direction, the concentrate falling down after spray can be dispersed again. This is preferable in case of treating a space for a long time.

Figure 7:
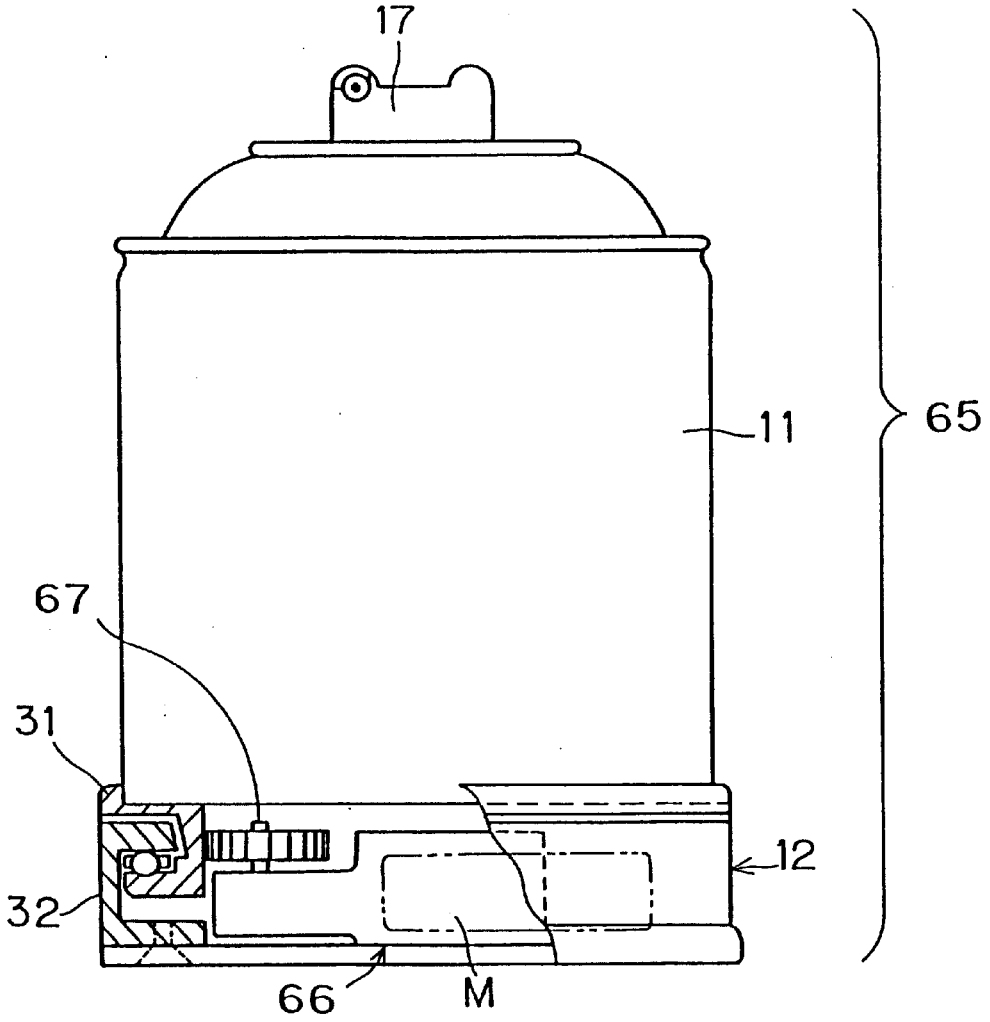
FIG. 7 is a frontal view of the essential portion showing further embodiment of the rotatable aerosol product according to the present invention.

In a rotatable aerosol product 65 in FIG. 7, a driving mechanism 66 is installed in the rotatable stand 12 to rotate the rotatable member 31. Such driving mechanism 66 can be constituted, for example, by a motor M with a speed reducer and a roller 68 fixed to an output shaft 67 of the speed reducer to abut against the inner face of the rotatable member 31. The rotatable member 31 is installed inside a fixing member 32 to make easy rotation. In replacing to the motor M with the speed reducer, other rotation driving element such as a spring, a flywheel can be employed. In this embodiment, the rotation force does not depend on counteraction of spray from the nozzle, so that the nozzle 13 needs no position eccentric from the rotation center. On the other hand, in some cases, the spray hole can be directed to a direction of rotation. Moreover, as a unique rotation driving element is installed, the rotation speed can be set relatively freely. Therefore, for example, during spraying the total amount of the aerosol composition inside the container 14, a product, rotating at a low frequency, such as a rotation at 360 degrees, namely, 1 rotation, or 2 to 3 rotations, can be constituted. However, the spray amount differs between the time of start to spray and the time when the amount remaining in the container becomes small, and therefore, in order to spray uniformly as possible, it is preferable to rotate two times or more, particularly in some frequencies, during spraying the total amount.

In the rotatable aerosol product 65 shown in FIG. 7, simultaneously with pressing the button 17 or immediately thereafter, the motor M is rotated and the container 14 is rotated to spray for use. On the other hand, a timer is installed and rotation and spray can be started some seconds after a switch is turned on. In case of rotation started by counteraction of spray, a locking mechanism may be adapted to install to lock rotation, the timer may be worked simultaneously with start of rotation, and after the predetermined time passes, the lock may be released. Moreover, it may be adapted that after a user takes shelter, spray is started, rotation is started, and lock of rotation is released by remote operation. Meanwhile, in combination of the timer with the motor, it is possible that rotation is carried out at an angle of 90 degrees or less for a first 5 seconds (3 frequencies/minute in rotation), and thereafter, rotation is carried out in 35 frequencies/minute or fewer. By this method, a user can take shelter until the nozzle faces the user, and thus, it can be prevented that the concentrate is sprayed on the user and the user inhales the concentrate. The timer and remote controller can be of an electric type and a mechanical type. In case of using the motor M, that of the electric type is preferable. On the other hand, when a flammable propellant is used, a battery is preferably used as an electric power source.

In any rotatable aerosol product as described above, the mechanism preferable to be installed is one to start to spray some seconds after an operation to press the button. By this mechanism, a user can have time to take shelter. Such mechanism can be realized by installing, in a spray passage (from the stem hole to the spray hole) of the aerosol product, a conventionally publicly known mechanism to delay start of spray by resistance obtained from air, viscous fluid, an elastic body, and the like. However, an aerosol product, rotating in an angle of 90 degrees or less for 5 seconds after the above-described operation, may be set to start spraying immediately after the start of the operation. This is because spray does not affect a user and the user can take shelter following confirmation of spray.

FIG. 8 shows a rotatable aerosol product 70 rotating in 90 degrees during spraying the total amount of the aerosol composition contained in the container 14. When arranged in a comer part with a door in a room 71, this product can spray all the aerosol composition while the direction of the nozzle 13 is rotated from a wall 72 at the one side to a wall 73 at the other side. The nozzle 13 of this product is never directed to a user, so that the user can make the product spray at ease and immediately take shelter from the door.

In the rotatable aerosol product 65 in FIG. 7, a circuit can be adopted to realize that when 90-degree rotation is obtained, a limit switch is turned on to make rotation of the motor M reversely. In this case, since the aerosol product 11 works for a reciprocating rotating motion in the angle range of 90 degrees, as shown in FIG. 8, it can be arranged in the comer part of the room 71 to be used, as well as realizing almost uniform spray in this range. This product can be constituted so as to make a reciprocating rotation in an angle of 90 degrees or larger, for example, a range from 180 degrees to 270 degrees, or an angle of 90 degrees or smaller, for example, from 30 to 60 degrees.

Figures 10A, 10B:
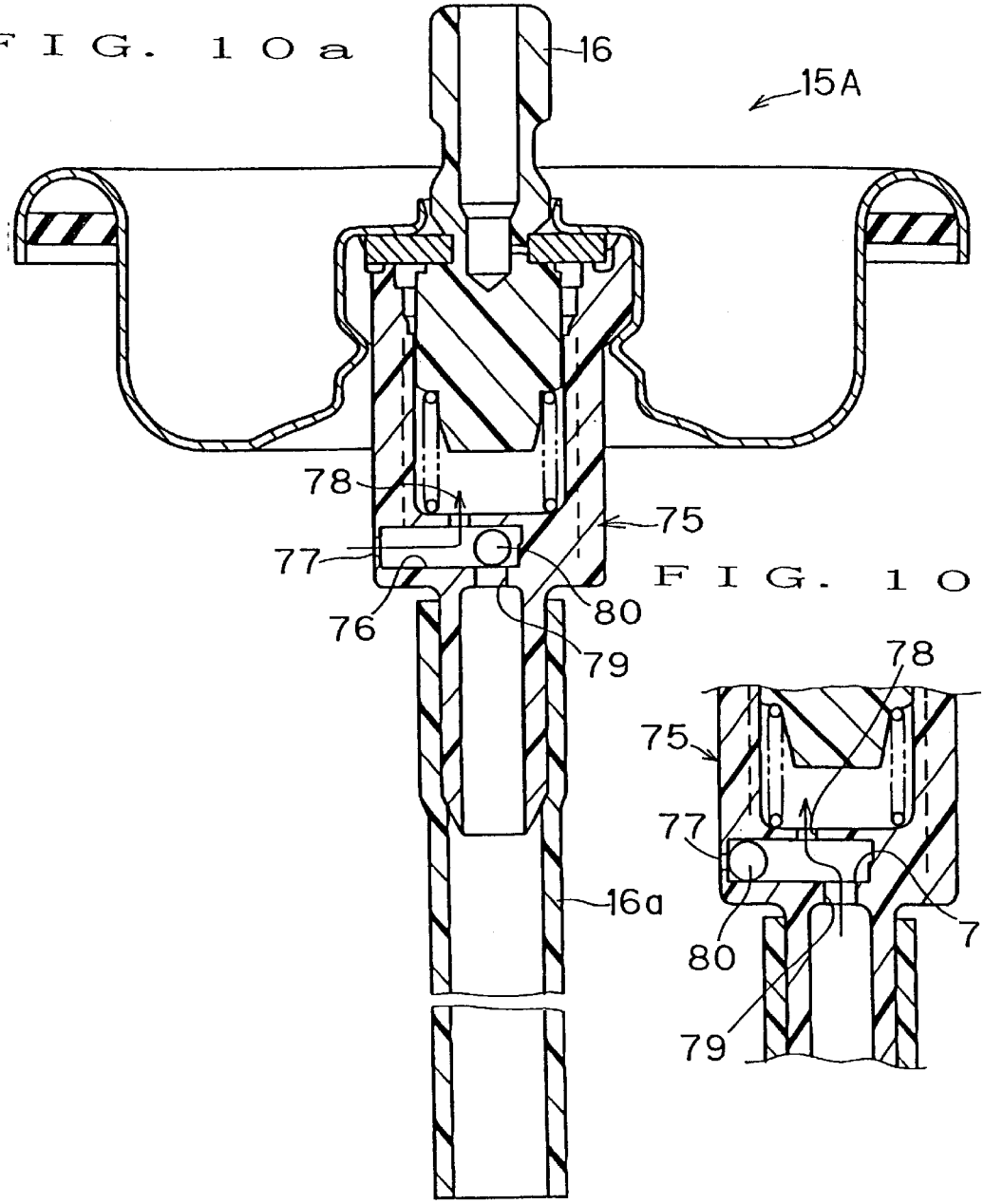
FIG. 10*a* is a sectional view showing an embodiment of a valve used for the aerosol product according to the present invention and FIG. 10*b* is a sectional view of an essential portion showing the working state thereof.
Figure 11:
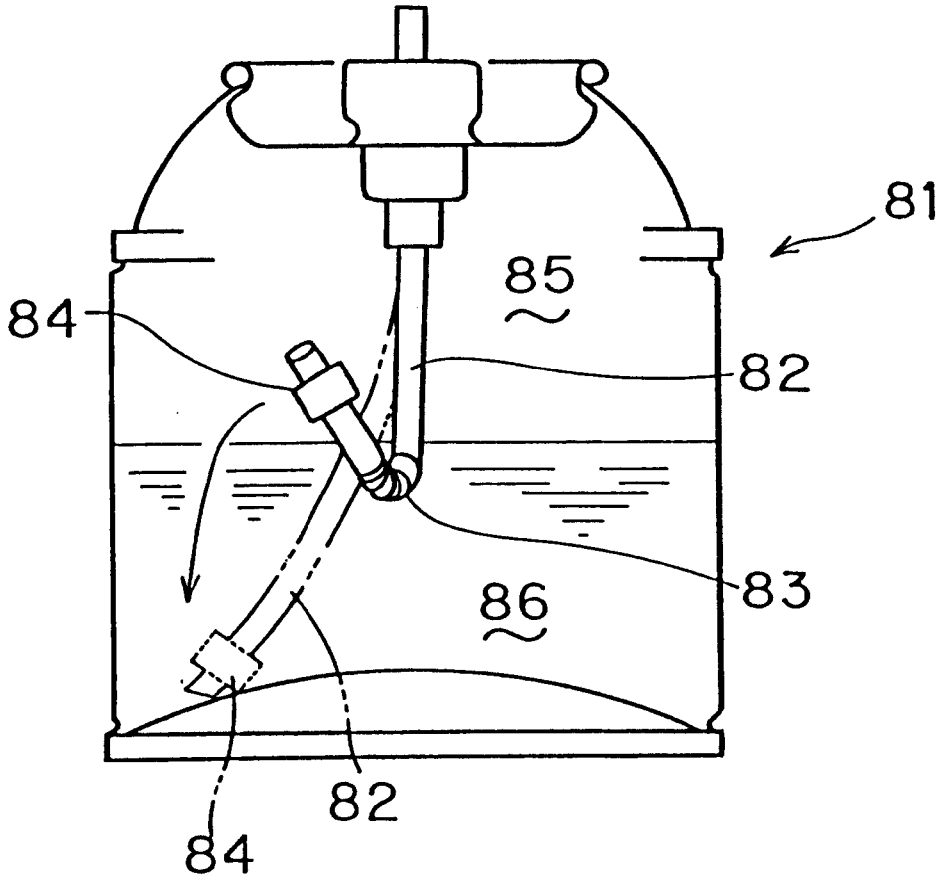
Fig. 11 is a sectional view showing still further embodiment of the aerosol product according to the present invention.

As the aerosol product of FIG. 7, when rotation is realized by the electrical or mechanical driving mechanism, rotation can be realized without spray. However, in case of rotation by counteraction of spray, it is possible that only gas is sprayed for rotation after operation, and when rotation becomes increasing, liquid is sprayed by counteraction of spray. FIGS. 10 and 11 show an embodiment of such aerosol product or valve. A valve 15A, shown in FIG. 10*a*, comprises a cylindrical cavity 76 extending outside from the central part to a radial direction in the bottom part of a housing 75. The end part of the cavity 76 communicates with the outside part of the housing 75 through a vapor tap 77 and the top portion thereof communicates with the inside of the housing 75 through a through hole 78. In addition, in the position corresponding to the center of the housing 75 at the bottom part of the cavity 76, a bottom hole 79 is formed to communicate with the dip tube 16*a*. Moreover, a ball 80 is housed movably as a closing member in the cavity 76.

In the aerosol product employing this valve 15A, at starting spray by pressing the stem 16 down, gas of liquefied gas and compressed gas in the gas phase is introduced from the vapor tap 77 and the ball 80 moves to the central part by the force of the introduced gas to close the bottom hole 79 (see FIG. 10*a*). Therefore, the aerosol product rotates by spraying only gas. When rotation increases, the ball 80 moves to the outside by centrifugal force (see FIG. 10*b*). Then, the vapor tap 77 is closed and the bottom hole 79 is opened. As the result, the aerosol composition (the liquid phase portion) is introduced to the housing 75 through the dip tube 16*a* to conduct mist spray.

As described above, in the aerosol product with the valve 15A in FIGS. 10*a* and 10*b*, the liquid phase portion is not sprayed at the start of spray, but only gas in the gas phase is sprayed, so that a user is almost free from getting a insecticide and the like. For reference, it is preferable to add compressed gas not hazardous to a human body, such as nitrogen gas and carbon dioxide gas, to the aerosol product consisting of a concentrate and a propellant, as a pressurizing agent. This case provides more safety as the pressurizing agent is first sprayed at the start of spray. In this product, the aerosol composition is sprayed a few minutes after the start of rotation, in other words, the ball 80 moves to the outside.

In an aerosol product 81 shown in FIG. 11, a dip tube 82 has a bent part 83 bendable and capable of a bending state and a weight 84 in the front end thereof. Before starting to use, as indicated by a solid line, the front end of the dip tube 82 is kept in a state of projecting to a gas phase part 85. Such bent part 83 can be realized by forming in a bellows shape and bending largely, for example. It may be available to keep bending form by using a weak spring piece and the like.

In this product, as the front end of the dip tube 82 communicates with the gas phase part 85 in an early stage, when the stem 16 is pressed down, only gas is first sprayed from the dip tube 82 to blow outside through the valve 15 and the stem 16. Therefore, the container starts to rotate by counteraction of spray. When rotation increases at a certain level, as indicated by the phantom line, the front end of the dip tube 82 enters the liquid phase part 86 by centrifugal force occurring in the weight 84. Thereby, the aerosol composition is sucked from the front end of the dip tube 82 to be sprayed outside through the stem 16.

Embodiments, including that in FIG. 1, have one nozzle or one spray hole. However, the numbers of the nozzle and the spray hole can be plural numbers, not restricted to only one. When a plurality of them is prepared, however, they are preferably arranged axial symmetrically around the rotation center. By such arrangement in axial symmetry, parallel moving components, in counteraction of the aerosol composition sprayed from the spray hole positioned eccentrically, offset each other, thereby remaining the only component to make rotation. Therefore, rotation becomes more stable and there are no possibility of falling down and one-way movement.

Figure 12A:
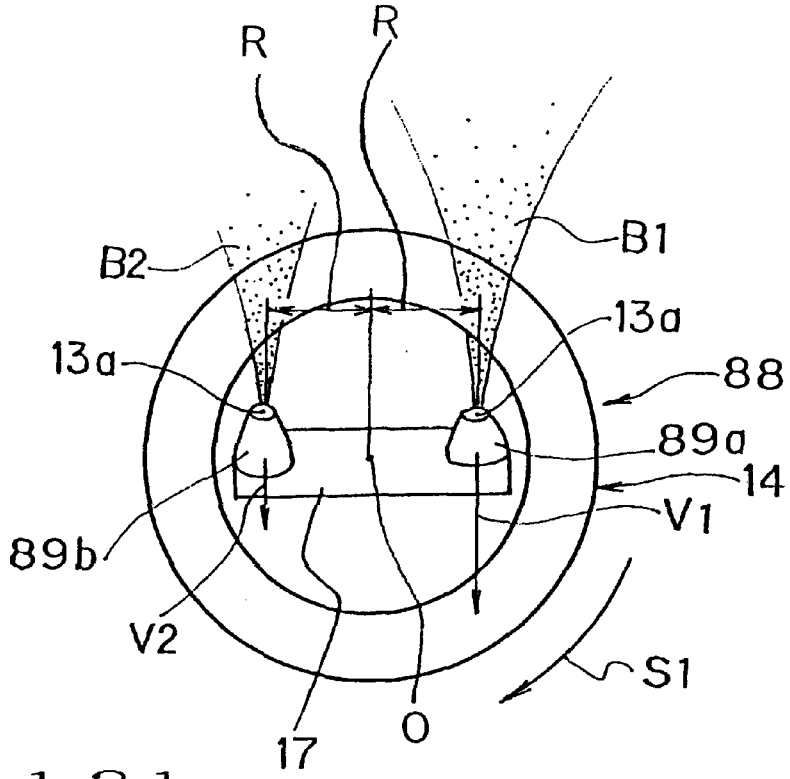
FIG. 12*a* and FIG. 12*b* are a plan view and a side view, respectively, showing still further embodiment of the aerosol product according to the present invention.
Figure 12B:
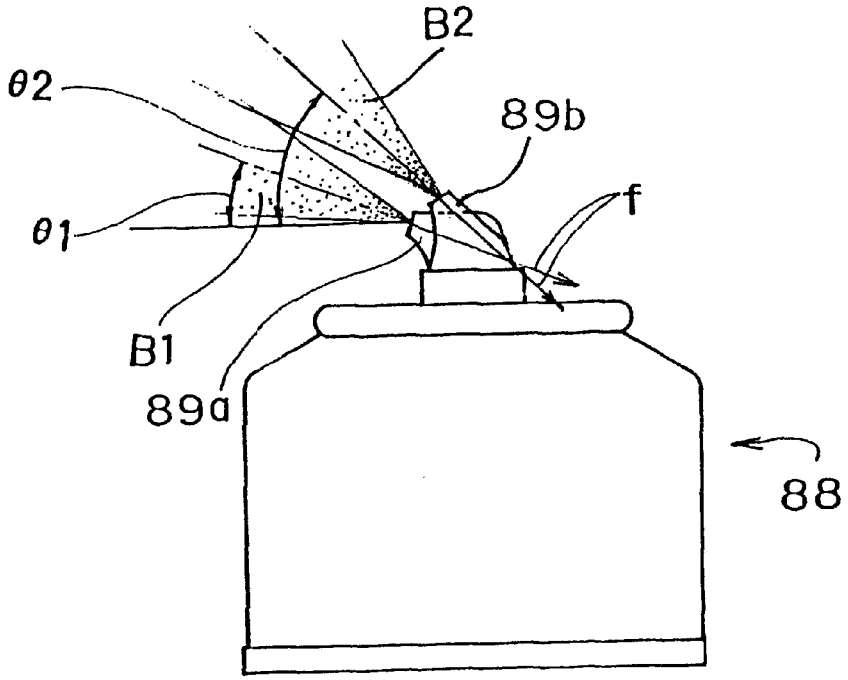

In a rotatable aerosol product 88 shown in FIGS. 12*a* and 12*b*, the bottom 17 is installed rotatably around the central axial (rotation center) O in a vertical direction to the container 14. The button 17 is laterally long. Nozzles 89*a* and 89*b* with the spray holes 13*a* are formed in positions with a distance R from the rotation center O, respectively, on the one side of the button 17. As shown in FIG. 12*b*, however, the spray hole 13*a* of the first nozzle 89*a* is directed upward at a certain angle θ1 to a horizontal plane. The spray hole 13*a* of the second nozzle 89*b* is directed upward at an angle θ2 larger than the angle θ1 to the horizontal plane. Therefore, a horizontal direction component V1 of the counteraction of spray from the first nozzle 89*a* is f·cos θ1 and a component horizontal direction V2 of the counteraction of spray from the second nozzle 89*b* is f·cos θ2. Thus, the bottom 17 rotates slowly in a clockwise direction (a direction indicated by an arrow S1) according to the difference between the both components (f·cos θ1−f·cos θ2).

When only one nozzle is employed, a product of multiplication of the horizontal direction component of counteraction of spray to the distance R from the rotation center O to the spray hole works as a torque. In this embodiment, as torque of both the nozzles work in an opposite direction, only difference in torque contributes to rotation. Consequently, rotation speed is low and the sprayed concentrate reaches far from the spray hole. On the other hand, a matter B1 sprayed from the first nozzle 89*a* is, like a conventional one, sprayed backward to a progress direction. However, the matter B2 from the second nozzle 89*b* is sprayed frontward to the progress direction to make the spray distance longer. On the other hand, the sprayed amount from the both nozzles 89*a* and 89*b* is twice as much as that of 1 nozzle, and hence, spray amount itself becomes more. For reference, although changeable depending on rotation speed, the matter B1 sprayed from the first nozzle 89*a* is sprayed in a low angle to reach far, while the matter B2 from the second nozzle 89*b* is sprayed in a high angle to reach upward, but horizontally in a short distance. As described above, the two nozzles 89*a* and 89*b* can spray in a wider range in a room compensating each other.

In case of FIG. 12, a magnitude of counteraction contributing to torque is changed between left and right hands by changing the angles of the two nozzles 89*a* and 89*b* in a horizontal direction. However, by other methods such as changing an inner diameter of the spray hole of the nozzle, the difference can be made between counteraction in the left and right hand. For example, in a rotatable aerosol product 90 shown in FIG. 13*a*, sizes of the spray holes and angles to the horizontal direction of the first nozzle 89*a* and the second nozzle 89*b* are equal and distances R1 and R2 from the rotation center O differ from each other. Also in this case, as torque (f×R) caused by counteraction of spray differs from each other, the product rotates slowly in the direction indicated by an arrow S1 on the basis of the difference in torque. In addition, in case of the rotatable aerosol product 90 shown in FIG. 13*b*, distances R from the rotation center O and angles to the horizontal direction are equal between the nozzles 89*a* and 89*b*, respectively, but angles θ3 and θ4 in the horizontal direction of the spray holes against a line between the spray hole and the rotation center differ. Thus, substantial distances R and R2 from the rotation center O are different to make a difference in torque. Therefore, depending on differences in torque, the product rotates slowly in the direction of the arrow S1.

In the embodiments of FIGS. 12, 13*a* and 13*b*, it is advantageous that the spray hole is installed in the same side as the button 17, so that a user can start spray in the state with the spray hole directed to the opposite side to the user, thereby taking shelter before the spray hole rotates to the user side. When a user has enough time to take shelter, such as in case of a timer type, as shown in FIG. 13*c*, the two nozzles 89*a* and 89*b* can be installed on each side of the button 17, respectively. Also in this case, when difference is provided in torque caused by counteraction of spray by changing the angle of the spray hole in the horizontal direction and in the vertical direction, or the distance from the rotation center O, the button 17 can be rotated slowly on the basis of the difference.

In the above-described embodiment, the button 17 is made rotatable and the two nozzles 89*a* and 89*b* are installed at the button 17. As the rotatable aerosol product 10 shown in FIG. 1, however, even if the button 17 is not rotated to the container 14, but if the aerosol product 11 is rotated in a body, the same action effect can be obtained. In addition, also if the rotation driving mechanism such as a motor is separately installed instead of using counteraction of spray, when the first nozzle backward and the second nozzle frontward to the rotation direction are installed, difference occurs between relative speeds of spray from the front and back nozzles to air, and hence, the difference between the spray-reaching distances. Thereby, the material sprayed from the first nozzle disperses the concentrate in an annular range near the aerosol product while the material sprayed from the second nozzle disperses the concentrate in the annular range far from the aerosol product. Therefore, a total range for dispersion of the concentrate is extended. In these cases, by differing each angle in the horizontal or vertical direction of each spray hole between the first and second nozzles, each spray range is differently set for each nozzle. Accordingly, the concentrate can be dispersed the concentrate in a wider range in a room.

In the rotatable aerosol product 90 shown in FIG. 14*a* one end of a tube 91 with flexibility and elasticity is attached to the top end of the button 17 and the nozzle 13 for spray is attached to a free end of the tube 91. The tube 91 also communicates with the stem 16 in the inside the button 17. In addition, around the front end of the tube 91, a weight 92 is attached. As shown in FIG. 14*b*, in order to exert counteraction on the tube 91 in a rotation direction, the tube 91 is bent at an angle θ5 somewhat laterally at the position of a reference numeral 93 around the bottom part of the weight 92. The above tube 91 is prepared with a synthetic resin, for example. On the other hand, in order to increase elasticity, a wire material made of spring steel may be embedded in the inside of the tube. The wire material may be in a linear or a coiled form.

Moreover, in this embodiment, a projection 94 to maintain a spray state is formed on the button 17 and a shoulder cover 95 is attached to a shoulder part of the container 14 and the step part 96 is formed on the shoulder cover 95 so as to fit to the projection 94. Thus, when rotation carried out by pressing the button 17, the projection 94 is engaged with the step part 96 to maintain the spray state. On the bottom part of the container 14, the rotatable stand 12 is installed.

In this product, the tube 91, in the early stage of rotation, extends almost straightly upward by elasticity thereof and counteraction of spray from the spray hole works almost downward. Therefore, torque caused by spray is small. Hence, the nozzle 13 rotates slowly bending slightly downward. Then, when rotation starts, centrifugal force exerting on the nozzle 13 and the weight 92 makes the tube 91 bend outward from a base part 91*a* as indicated by the phantom line. As the result, the distance R from the rotation center O of the nozzle 13 increases gradually, as well as the direction of the spray hole approaching a horizontal position. Therefore, rotation torque caused by counteraction further increases to make more degree of slope. As described above, the rotatable aerosol product 90 sprays upward at a low rotation speed in the early stage of spray, and as progressing spray, sprays laterally at a higher rotation speed. Consequently, the product can widely disperse the concentrate from an upward position of the rotatable aerosol product 90 to a far position of a room.

As shown in FIG. 13*c*, this product may also comprise the nozzles 89*a* and 89*b* in the both sides of the tube to be rotated by difference in torque of the both nozzles. This embodiment can be applied to the rotatable aerosol product made by combination of the rotatable stand 12 and the aerosol product 11 as shown in FIG. 1 and the rotatable aerosol product separately having the rotation driving mechanism such as a motor. The weight 92 is used in the said embodiment, but, when elasticity of the tube 91 is weak, almost the same action can be expected with the weight of the nozzle 13 itself or the tube 91 itself. In this case, the weight 92 can be omitted.

In the rotatable aerosol product 90 shown in FIG. 14*a*, the tube 91 is made flexible from the base part 91*a* by its flexibility. As shown in the FIG. 14*c*, however, the tube 91 itself may be made of a metal pipe with rigidity and the base part thereof may be connected with the button 17 by using a connecting tube 97 with flexibility. In such case, it is preferable to energize the base part of the tube 91 by using a coil spring 95 or the like to recover a straightly upward form. In this case, when rotation speed becomes lower, the tube 91 recovers the upward form again. In other words, immediately after the start of spray, the nozzle 13 moves from above to a horizontal position. When the amount of the aerosol product in the container 14 reduces and rotation becomes slow, the nozzle 13 performs the reciprocating motion returning from horizontal to upward direction. Therefore, the concentrate can be dispersed in a wide range. In replacing to the connecting tube 97, the tube 91 may be rotatably connected by using a rotary joint. Moreover, as a metal and a synthetic resin, by constituting the tube 91 and the member to connect the tube with different materials, the tube 91 itself can be rotated around the member.

Figure 15A:
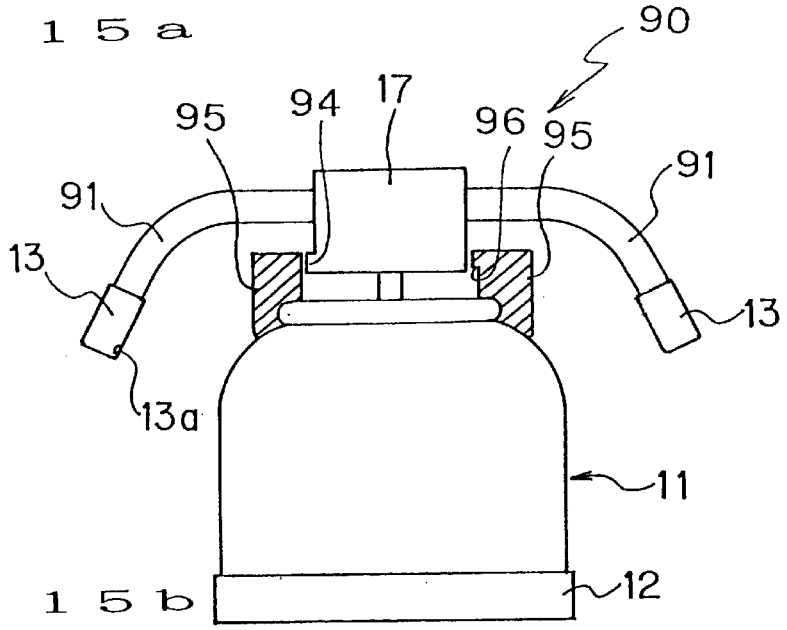
FIG. 15*a* is a side view of a partially sectional view showing still further embodiment of the aerosol product according to the present invention and FIG. 15*b* is a side view of a partially sectional view showing a using state of the aerosol product and FIG. 15*c* is a perspective side view combined with an object of use of the aerosol product.

The rotatable aerosol product 90 shown in FIG. 15*a* is substantially same as that of FIG. 14*a*, except that the two tubes 91 are attached laterally to positions distant at 180 degrees from the button 17. In the front end of the tubes 91, the nozzles 13 are mounted to work as a weight. In addition, the projection 94 and the shoulder cover 95 are same as those in FIG. 14*a*. The spray hole 13*a* of each nozzle 13 may be installed in the direction to cause torque in the same direction and also in each reverse direction to the aerosol product 11. In the latter case, difference in counteraction of each spray should be made in the spray forces to rotate.

Figure 15B:
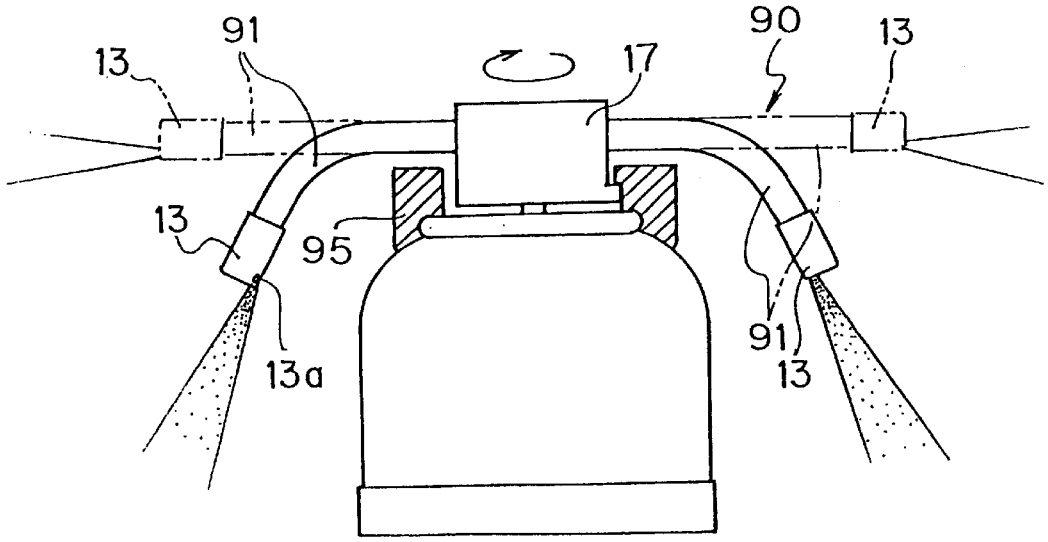

In the rotatable aerosol product 90, in the state of no rotation, the tube 91 curves downward in the middle position thereof. As shown in FIG. 15*b*, when the button 17 is pressed to rotate somewhat and the projection 94 is engaged with the step part 96 of the shoulder cover 95 to spray, the aerosol container 11 starts rotation in a body on the rotatable stand 12 by the counteraction or by the difference between the counteraction of spray from the spray holes 13*a*. In the early stage, the spray hole 13*a* of the nozzle 13 is positioned obliquely downward to disperse the concentrate relatively near the rotatable aerosol product 90. Then, when rotation becomes fast, the both tubes 91 are extended by the centrifugal force, and thus, the spray hole 13*a* is directed to the lateral direction. Therefore, the concentrate sprayed from the spray hole 13*a* reaches far.

Figure 15C:
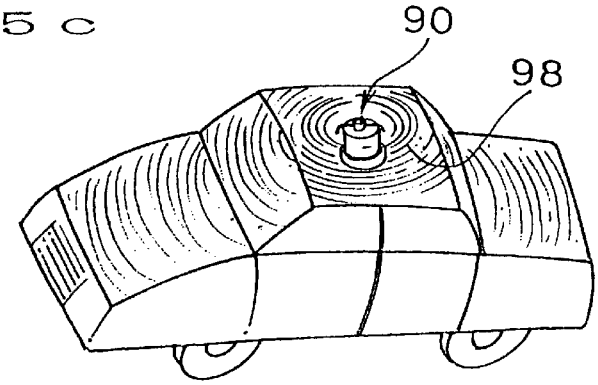

When the remaining amount reduces and the internal pressure becomes lower, rotation becomes slow. In this case, the rotatable aerosol product 90 can uniformly disperse the concentrate near to far from the position of the rotatable aerosol product 90 through the tube 91 directing downward and elongating laterally. Hence, the product can be used for dispersing a drug to treat a carpet and a floor, for example, a insecticide and deodorant, and used for dispersing a detergent to a body of an automobile. When a detergent is dispersed to a body of an automobile, as shown in FIG. 15*c*, for example, the content is sprayed by rotating the aerosol production in the state with the above rotatable aerosol product 90 placed on a roof of an automobile 98. Accordingly, the detergent can be dispersed to the whole surface of the body.

In the said embodiments, aerosol products of the total amount spray type are shown, but the rotatable aerosol product according to the present invention is not restricted to this. For example, aerosol products of such type as a specific amount spray or a specific time spray type, including a product to spray a deodorant temporarily to an inside of an automobile and a room.

EXPERIMENTAL EXAMPLE

An effect of the rotatable aerosol product according to the present invention is described with reference of experimental examples. Two kinds of the aerosol products presented in Table 1 below were filled in a tinplate-made 3-piece can (used throughout all experimental groups) of 180 ml full volume and two kinds of the aerosol containers with a valve and a button defined in Table 2 to manufacture four kinds of the aerosol products.

TABLE 1

| | Concentrate (wt %) | Propellant (wt %) |
|---|---|---|
| Formulation 1 | Ethanol 50 | Dimethyl ether 50 |
| Formulation 2 | Ethanol 20 | Dimethyl ether 80 |

TABLE 2

| | Stem hole (mm) | Housing hole (mm) | Spray hole (mm) |
|---|---|---|---|
| Specification A | 0.3 | 2.0 | 0.5 |
| Specification B | 0.5, 2 sites | 2.0 | 0.6 |

Figure 16:
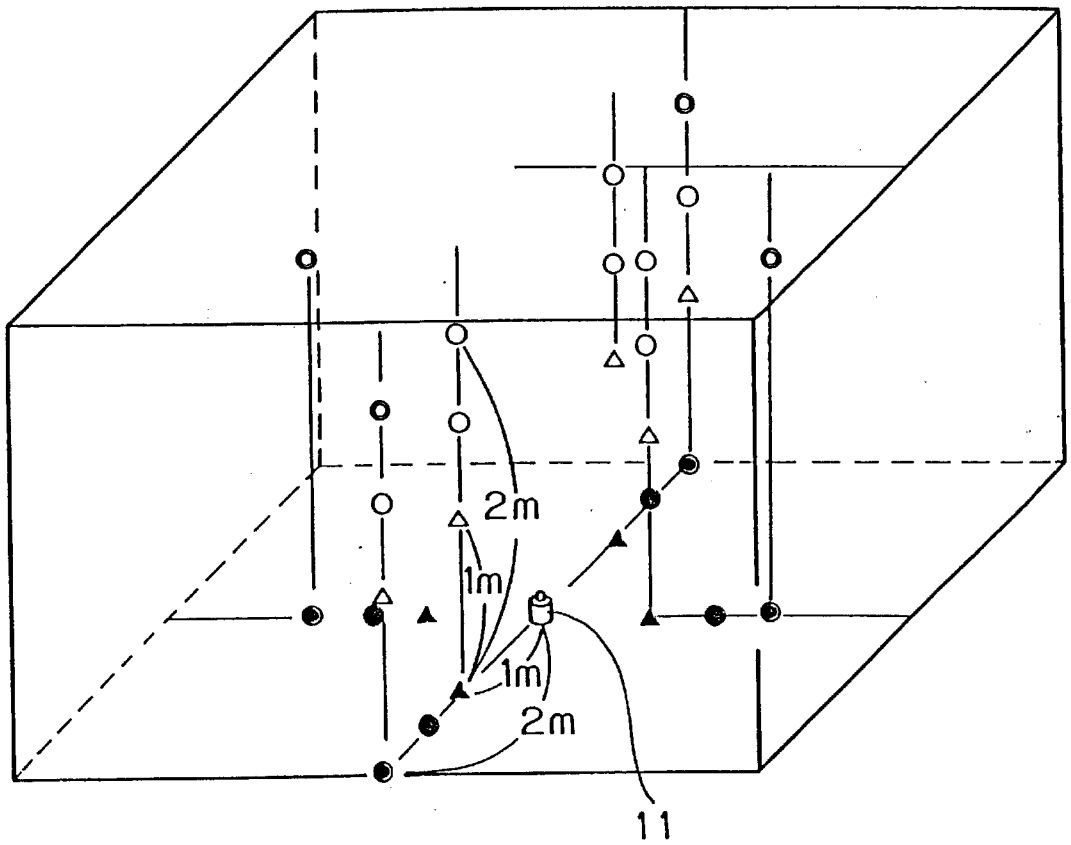
FIG. 16 is a perspective side view showing a method for measurement of an effect of examples of the rotatable aerosol product according to the present invention.
Figure 17:
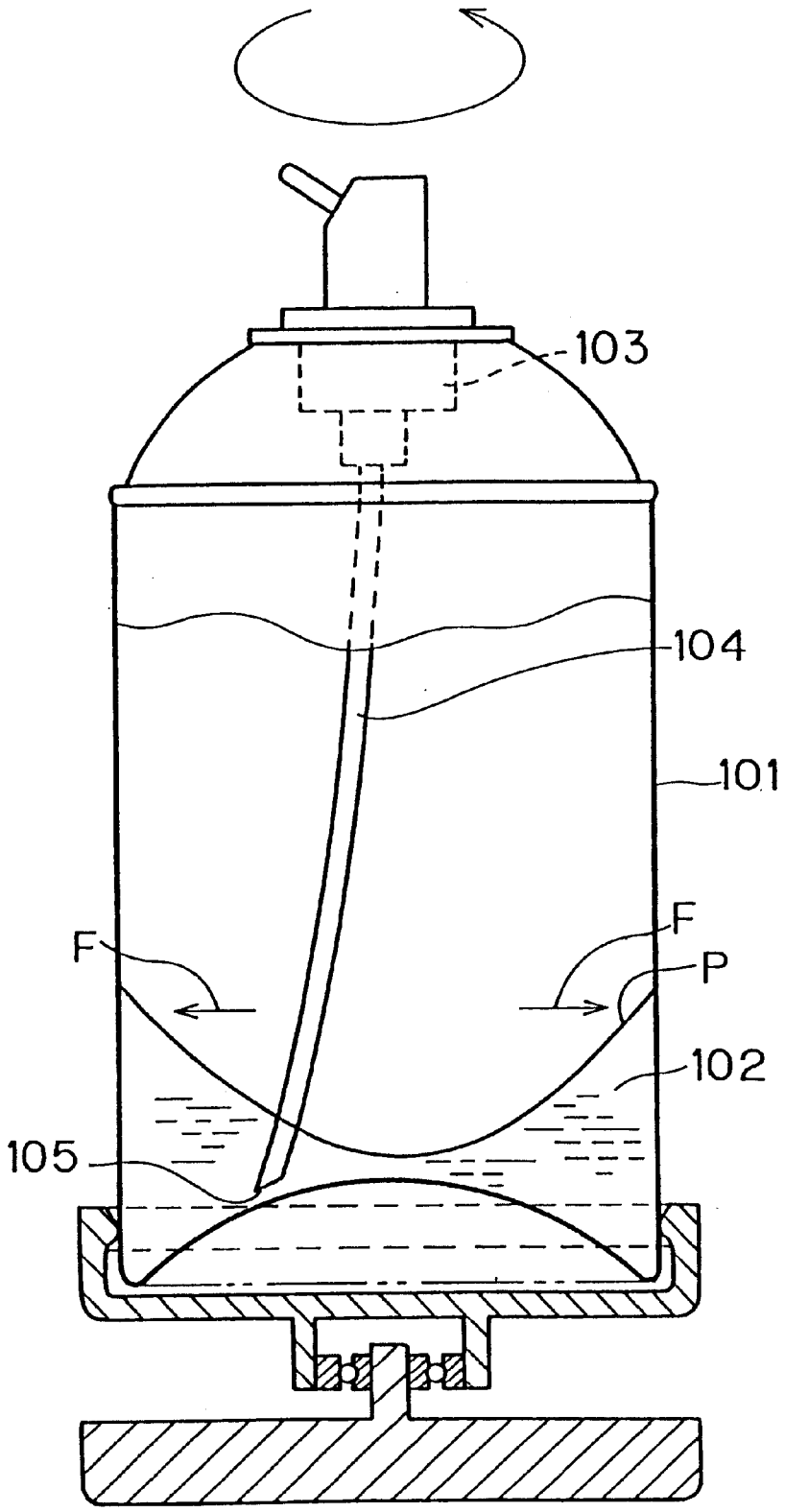
FIG. 17 is a sectional view showing a using state of a conventional rotatable aerosol product.

Each of the above aerosol products was fixed to the rotatable stand to spray rotating at each rotation frequency shown in Table 3. At this time, dispersibility to space and adhesivity to a floor surface were tested. The results are also presented in Table 3. In the test, the rotatable stand and the aerosol product 11 were arranged in a center of a room with a width of 4 m×4 m and a height of 2.5 m as shown in FIG. 16 and. The inside of the room was kept at a no-wind condition.

TABLE 3

[Test results]

| | Rotation (frequency/min) | Formulation | Specification | Dispersibility in space | Adhesion to floor face |
|---|---|---|---|---|---|
| 1 | 10 | 1 | A | a | a |
| 2 | 10 | 1 | B | a | a |
| 3 | 10 | 2 | A | a | a |
| 4 | 10 | 2 | B | a | a |
| 5 | 20 | 1 | A | b | a |
| 6 | 20 | 1 | B | a | a |
| 7 | 20 | 2 | A | a | a |
| 8 | 20 | 2 | B | a | a |
| 9 | 30 | 1 | A | b | b |
| 10 | 30 | 1 | B | b | a |
| 11 | 30 | 2 | A | a | a |
| 12 | 30 | 2 | B | a | a |
| 13 | 35 | 1 | A | b | b |
| 14 | 35 | 1 | B | b | b |
| 15 | 35 | 2 | A | b | b |
| 16 | 35 | 2 | B | b | a |
| 17 | 40 | 1 | A | d | d |
| 18 | 40 | 1 | B | d | c |
| 19 | 40 | 2 | A | c | c |
| 20 | 40 | 2 | B | c | b |

[Method for evaluation] The aerosol product was arranged in the center of the room FIG. 16, a paper reactive to ethanol was put in a place with horizontal distances of 1 m, 1.5 and 2 m and heights of 0 m, 1.5 m and 2 m from the product, and after spray was completed, presence or absence of any reaction was examined.

Dispersibility in Space

Presence or absence of any reaction was examined in the places with horizontal distances of 1 m, 1.5 m and 2 m and heights of 1 m, 1.5 m and 2 m from the product. Evaluation of the test results is presented as below.

a: reaction observed in all the places.

b: reaction found within the horizontal distance of 1.5 m and the height of 1.5 m.

c: reaction found only at the horizontal distances of 1 m and the height of 1 m.

d: No reaction observed.

Adhesion to the Floor Face

Presence or absence of any reaction was examined in the places with horizontal distances of 1 m, 1.5 m and 2 m and the height of 1 m from the product. Evaluation of the test result is presented as below.

a: reaction observed in all the places.

b: reaction was found within the horizontal distance of 1 m and the height of 1.5 m.

c: reaction found only at the horizontal distance of 1 m.

d: No reaction observed.

From the above results, when rotation is 35 frequencies/minute or lower, the evaluations, for both dispersibility in space and adhesion to the floor surface, were "a" or superior and dispersion in a relatively wider range is shown. In addition, when rotation is 30 frequencies/minute or lower, the evaluation of "a" was seen in the most of the cases and dispersion in a wide range is shown. Particularly, in case of 10 frequencies/minutes, all cases evaluated as "a" and it can be known that lower rotation speed makes dispersion range wider. On the other hand, in case of 40 frequencies/minutes, almost cases evaluated as "c" or "d", showing dispersion not far enough.

What is claimed is:

1. A rotatable aerosol product, comprising:

a container extending along and centrally about an axis of rotation and including at least one spray hole formed into a top end portion of the container and offset from the axis of rotation, the container containing an aerosol composition; and a rotatable stand connected to a bottom end portion of the container wherein, when aerosol is dispensed from the rotatable aerosol product in a form of spray emitted from the at least one spray hole, at least the container and the at least one spray hole rotate about the axis of rotation at 35 frequencies/minute or less.

2. The rotatable aerosol according to claim 1, wherein a direction of the spray hole ranges from −10 to 70 degrees upwardly relative to a horizontal plane.

3. The aerosol product according to claim 1, wherein a spray amount ranges from 7 to 30 g/10 seconds.

4. The rotatable aerosol product according to claim 1, wherein a proportion of a propellant contained in the aerosol composition ranges from 25 to 90 wt %.

5. The rotatable aerosol product according to claim 1, wherein rotation is realized by counteraction of the spray.

6. The rotatable aerosol product according to claim 5, wherein a first spray hole rotates said container in a first direction relative to the axis of rotation and a second spray hole rotates in a reverse direction opposite the first direction, wherein rotation of the container is realized by a difference in counteraction of spray from the first spray hole and the second spray hole.

7. The rotatable aerosol product according to claim 1, wherein rotation ranges from 45 to 720 degrees for a period of time from commencement of spray until a total amount of the spray is dispensed.

8. The rotatable aerosol product according to claim 1, wherein spray or rotation is started after a predetermined time passes.

9. The rotatable aerosol product according to claim 1, wherein 5 seconds or more lapses until rotation reaches 90 degrees.

10. The rotatable aerosol product according to claim 9, further comprising rotation resistance means for generation of resistance to rotation, wherein resistance reduces after rotation starts.

11. The rotatable aerosol product according to claim 1, further comprising means to spray only gas initially and after a predetermined time passes, to start to spray into a mist.

12. The rotatable aerosol product according to claim 11, further comprising means for communicating to a valve a gas phase part initially to cause rotation by applying counteraction of sprayed gas, and when rotation speed increases, means for communicating to the valve with a liquid phase part of the composition.

13. The rotatable aerosol product according to claim 12, further comprising a closing member movable between a first position which closes a bottom hole communicating with a dip tube and a second position which closes a vapor tap in which a radius of the second position from the center of rotation is larger than a radius of the first position from the center of rotation.

14. The rotatable aerosol product according to claim 1, wherein the spray hole is installed movably on the container between a first radial position and angular position with a small torque of counteraction and a second radial position and angular position with a large torque of counteraction, and constituted so as to move from the first radial position to the second radial position when the centrifugal force becomes large, as well as elastically energized so as to normally return to the first position.

15. The rotatable aerosol product according to claim 1, wherein a nozzle is installed rotatably from an erect state to a fallen state against the top end of the main body of the container and is energized elastically so as to move from a normally directed upward condition to a rotating outside directed condition, the spray hole being formed on a front end of the nozzle.

16. The rotatable aerosol product according to claim 1, wherein the at least one spray hole includes a first spray hole to spray backwards relative to a direction of rotation and a second spray hole to spray forwards relative to the direction of rotation.

17. The rotatable aerosol product according to claim 16, wherein respective angles of a horizontal and/or vertical direction of the first spray hole and the second spray hole differ from one another.

18. An aerosol spray can according to claim 17, further comprising at least three balls disposed between the support member and the rotatable member and spaced apart from one another at a distance sufficient to support the rotatable member on the support member.

19. An aerosol spray can adapted for spraying an aerosol composition therefrom while resting on a support surface, the aerosol spray can comprising:

a hollow container extending along and centrally about an axis of rotation and having a top end portion and a bottom end portion, the container containing the aerosol composition;

a valve assembly connected to the top end portion of the container in a sealed manner and having a spray hole defined by a nozzle, the spray hole extending along a spray hole axis disposed in an offset, non-parallel manner relative to the axis of rotation; and an annular rotatable stand including a support member and a rotatable member rotatably connected to the support member, the rotatable member fixedly connected to the bottom end portion of the container in a manner such that when the aerosol composition is dispensed from the container through the spray hole with the support member of the aerosol spray can resting on the support surface in a facially opposing manner, the container, the valve assembly and the rotatable member rotate about the axis of rotation while the support member remains stationary on the support surface.

20. A rotatable aerosol product, comprising:

a container extending along and centrally about an axis of rotation and including at least one spray hole formed into a top end portion of the container and offset from the axis of rotation, the container containing an aerosol composition; and means to spray only gas initially and after a predetermined time passes, to start to spray into a mist, wherein, when aerosol is dispensed from the rotatable aerosol product in a form of spray emitted from the at least one spray hole, at least the container and the at least one spray hole rotate about the axis of rotation at 35 frequencies/minute or less.

21. The rotatable aerosol product according to claim 20, further comprising means for communicating to a valve a gas phase part initially to cause rotation by applying counteraction of sprayed gas, and when rotation speed increases, means for communicating to the valve a liquid phase part of the composition.

22. The rotatable aerosol product according to claim 20, further comprising a closing member movable between a first position which closes a bottom hole communicating with a dip tube and a second position which closes a vapor tap in which a radius of the second position from the center of rotation is larger than a radius of the first position from the center of rotation.

23. A rotatable aerosol product, comprising:

a container extending along and centrally about an axis of rotation and including at least one spray hole formed into a top end portion of the container and offset from the axis of rotation, the container containing an aerosol composition;

wherein, when aerosol is dispensed from the rotatable aerosol product in a form of spray emitted from the at least one spray hole, at least the container and the at least one spray hole rotate about the axis of rotation at 35 frequencies/minute or less, and wherein the spray hole is installed movably on the container between a first radial position and angular position with a small torque of counteraction and a second radial position and angular position with a large torque of counteraction, and constituted so as to move from the first radial position to the second radial position when the centrifugal force becomes large, as well as elastically energized so as to normally return to the first position.

24. A rotatable aerosol product, comprising:

a container extending along and centrally about an axis of rotation and including at least one spray hole formed into a top end portion of the container and offset from the axis of rotation, the container containing an aerosol composition; and wherein, when aerosol is dispensed from the rotatable aerosol product in a form of spray emitted from the at least one spray hole, at least the container and the at least one spray hole rotate about the axis of rotation at 35 frequencies/minute or less, and wherein a nozzle is installed rotatably from an erect state to a fallen state against the top end of the main body of the container and is energized elastically so as to move from a normally directed upward condition to a rotating outside directed condition, the spray hole being formed on a front end of the nozzle.

25. A rotatable aerosol product, comprising:

a container extending along and centrally about an axis of rotation and including at least one spray hole formed into a top end portion of the container and offset from the axis of rotation, the container containing an aerosol composition;

wherein, when aerosol is dispensed from the rotatable aerosol product in a form of spray emitted from the at least one spray hole, at least the container and the at least one spray hole rotate about the axis of rotation at 35 frequencies/minute or less, and wherein spray is started after a predetermined time passes.

26. A rotatable aerosol product, comprising:

a container extending along and centrally about an axis of rotation and including at least one spray hole formed into a top end portion of the container and offset from the axis of rotation, the container containing an aerosol composition;

wherein, when aerosol is dispensed from the rotatable aerosol product in a form of spray emitted from the at least one spray hole, at least the container and the at least one spray hole rotate about the axis of rotation at 35 frequencies/minute or less, and wherein a first spray hole rotates said container in a first direction relative to the axis of rotation and a second spray hole rotates in a reverse direction opposite the first direction, wherein rotation of the container is realized by a difference in counteraction of spray from the first spray hole and the second spray hole.

27. A rotatable aerosol product, comprising:

a container, the container having a trunk portion and a bottom portion, the bottom portion fixedly attached to a trunk bottom portion by a winding-up part;

a rotatable stand, the rotatable stand having an annular rotatable member filled in the winding-up part, an annular supporting member arranged in a downward position of the rotatable member, at least three balls interposed between the rotatable member and the supporting member, and a retainer that maintains a distance between the balls;

wherein a container having at least one spray hole rotates about a central vertical axis of the container, an aerosol is dispensed from the rotatable product in the form of spray while rotating, and the winding-up portion is supported by the supporting member through a row of the balls dispersed in a wide range.

* * * * *